US011618617B2

(12) United States Patent
Jones et al.

(10) Patent No.: US 11,618,617 B2
(45) Date of Patent: Apr. 4, 2023

(54) BEVERAGE CONTAINER LID ASSEMBLY

(71) Applicant: Specialized Bicycle Components, Inc., Morgan Hill, CA (US)

(72) Inventors: Ryan Curt Jones, Hollister, CA (US); Lauren B. Margolin, Emeryville, CA (US)

(73) Assignee: SPECIALIZED BICYCLE COMPONENTS, INC., Morgan Hill, CA (US)

( * ) Notice: Subject to any disclaimer, the term of this patent is extended or adjusted under 35 U.S.C. 154(b) by 0 days.

(21) Appl. No.: 17/407,673

(22) Filed: Aug. 20, 2021

(65) Prior Publication Data

US 2022/0063876 A1 Mar. 3, 2022

Related U.S. Application Data

(60) Provisional application No. 63/069,983, filed on Aug. 25, 2020.

(51) Int. Cl.
*B65D 47/12* (2006.01)
*B65D 43/02* (2006.01)

(52) U.S. Cl.
CPC ..... *B65D 47/123* (2013.01); *B65D 43/0229* (2013.01)

(58) Field of Classification Search
CPC ..... B65D 47/123; B65D 43/0229; B65D 2543/00046; B65D 47/244; B65D 81/3841; A47G 19/2272; A47G 19/2288
See application file for complete search history.

(56) References Cited

U.S. PATENT DOCUMENTS 2,425,313 A * 8/1947 Hammerstein ..... A47G 19/24 222/500
2,899,098 A 9/1955 Gits
3,058,631 A 10/1962 De La Hitte
3,269,606 A * 8/1966 Armstrong ..... F25D 31/002 366/264
D286,604 S 11/1986 Bierlein et al.
D320,558 S 10/1991 Timm
5,467,891 A 11/1995 Perry
5,713,493 A 2/1998 Garibaldi
(Continued)

FOREIGN PATENT DOCUMENTS

CN 204078374 U 1/2015
EP 3342436 A1 * 7/2018 ..... A61B 5/14
(Continued)

OTHER PUBLICATIONS

European Patent Office Extended Search Report for Application No. 21192666.2 dated Jan. 31, 2022 (11 pages).

*Primary Examiner* — Donnell A Long
(74) *Attorney, Agent, or Firm* — Michael Best & Friedrich LLP

(57) ABSTRACT

A lid assembly configured to be coupled to a beverage container, the lid assembly including a base defining an axis, a sip ring rotatable about the axis with respect to the thread base, and an elevator assembly coupled to the sip ring. The elevator assembly includes an upper elevator and a lower elevator coupled to the upper elevator for co-rotation with the upper elevator. Rotation of the sip ring rotation of the sip ring is configured to cause the elevator assembly to translate along the axis.

23 Claims, 17 Drawing Sheets

(56) References Cited

U.S. PATENT DOCUMENTS

| | | | |
|---|---|---|---|
| D457,034 | S | 5/2002 | Bodum |
| 6,702,138 | B1 | 3/2004 | Bielecki |
| D535,151 | S | 1/2007 | Seum et al. |
| 7,261,226 | B2 | 8/2007 | Adams et al. |
| D586,182 | S | 2/2009 | Trombly |
| 7,686,194 | B2 | 3/2010 | Kasting |
| D615,359 | S | 5/2010 | George |
| D622,545 | S | 8/2010 | Wahl |
| D627,196 | S | 11/2010 | George |
| D632,525 | S | 2/2011 | George |
| D640,505 | S | 6/2011 | George |
| D654,762 | S | 2/2012 | Gilbert |
| D659,474 | S | 5/2012 | Wahl et al. |
| D660,084 | S | 5/2012 | Gilbert |
| D662,761 | S | 7/2012 | Wahl |
| D691,848 | S | 10/2013 | Trudeau et al. |
| D702,086 | S | 4/2014 | Thurlow |
| D751,338 | S | 3/2016 | Seiders et al. |
| D751,339 | S | 3/2016 | Seiders et al. |
| D751,340 | S | 3/2016 | Seiders et al. |
| D751,341 | S | 3/2016 | Seiders et al. |
| D752,397 | S | 3/2016 | Seiders et al. |
| D760,586 | S | 7/2016 | Seiders et al. |
| D761,619 | S | 7/2016 | Seiders et al. |
| D763,039 | S | 8/2016 | Ionov |
| D774,363 | S | 12/2016 | Seiders et al. |
| D774,837 | S | 12/2016 | Seiders et al. |
| D779,285 | S | 2/2017 | Seiders et al. |
| D779,891 | S | 2/2017 | Seiders et al. |
| D779,892 | S | 2/2017 | Seiders et al. |
| D780,530 | S | 3/2017 | Seiders et al. |
| D780,531 | S | 3/2017 | Seiders et al. |
| D780,532 | S | 3/2017 | Seiders et al. |
| D780,533 | S | 3/2017 | Seiders et al. |
| D780,577 | S | 3/2017 | Seiders et al. |
| D781,145 | S | 3/2017 | Seiders et al. |
| D781,146 | S | 3/2017 | Seiders et al. |
| D781,662 | S | 3/2017 | Seiders et al. |
| D782,881 | S | 4/2017 | Seiders et al. |
| D783,367 | S | 4/2017 | Seiders et al. |
| D783,368 | S | 4/2017 | Seiders et al. |
| D784,072 | S | 4/2017 | Baron et al. |
| D784,775 | S | 4/2017 | Seiders et al. |
| D786,025 | S | 5/2017 | Seiders et al. |
| D788,544 | S | 6/2017 | Seiders et al. |
| D790,285 | S | 6/2017 | Seiders et al. |
| D794,397 | S | 8/2017 | Seiders et al. |
| D795,019 | S | 8/2017 | Seiders et al. |
| D795,020 | S | 8/2017 | Seiders et al. |
| D824,602 | S | 7/2018 | Danenberg et al. |
| D839,675 | S | 2/2019 | Beckman |
| D842,038 | S | 3/2019 | Seiders et al. |
| D878,160 | S | 3/2020 | Corbet et al. |
| 2006/0196894 | A1* | 9/2006 | Lindsay ..... B65D 47/244 222/521 |
| 2010/0155358 | A1 | 6/2010 | George |
| 2019/0069699 | A1 | 3/2019 | Nichols et al. |
| 2020/0130904 | A1 | 4/2020 | Jones et al. |

FOREIGN PATENT DOCUMENTS

| | | | | |
|---|---|---|---|---|
| EP | 3741267 | A1 | 11/2020 | |
| WO | WO-2011020501 | A1 * | 2/2011 | ..... A47G 19/2272 |

* cited by examiner

BEVERAGE CONTAINER LID ASSEMBLY

CROSS-REFERENCE TO RELATED APPLICATIONS

This application claims priority to U.S. Provisional Application No. 63/069,983, filed Aug. 25, 2020, the entire contents of which are incorporated herein by reference.

BACKGROUND

The present disclosure relates generally to the field of beverage containers and specifically to closable lids for beverage containers.

Beverage container assemblies are commonly used to carry cold and/or warm liquid beverages (e.g., water, soda, coffee, etc.). Beverage container assemblies typically include a hollow main container, and a lid coupled to an upper end of the container. The lid, or a portion thereof, can be movable between open and closed positions.

DETAILED DESCRIPTION

Figure 1:
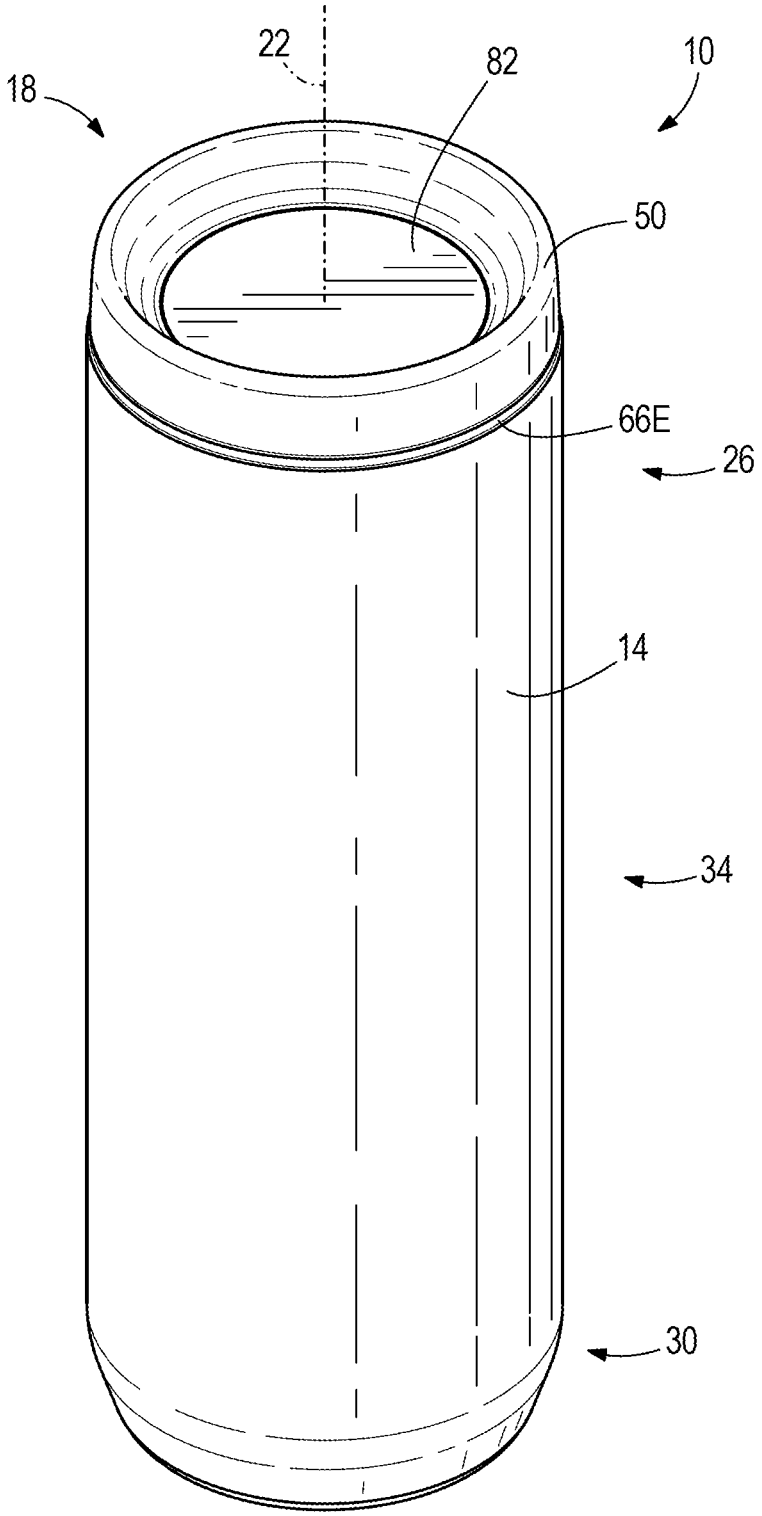
FIG. 1 is a perspective, assembled view of a beverage container assembly according to one embodiment.

Before any embodiments are explained in detail, it is to be understood that the disclosure is not limited in its application to the details of construction and the arrangement of components set forth in the following description or illustrated in the following drawings. The disclosure is capable of other embodiments and of being practiced or of being carried out in various ways.

Embodiments described herein disclose, for example, a lid assembly that may be coupled to a beverage container. The lid assembly may include a thread base defining an axis, a sip ring rotatable about the axis with respect to the thread base, and an elevator assembly coupled to the sip ring. The elevator assembly may include an upper elevator and a lower elevator coupled to the upper elevator for co-rotation with the upper elevator. Rotation of the sip ring may cause the elevator assembly to translate along the axis.

In some embodiments, the thread base may include a follower and the elevator assembly may include a track at least partially received by the follower. The track may have a variable slope along a length of the track. The elevator assembly may include a first seal and a second seal axially spaced along the axis from the first seal. A tortuous flow path may be positioned between the first seal and the second seal. The elevator assembly may be coupled to the sip ring for co-rotation with the sip ring about the axis. The elevator assembly may include a slot, and the sip ring may include a tab that is received within the slot. The tab may include a rail that extends partially around the axis. The thread base may include a stop that abuts a surface of the tab. The stop may be a first stop and the surface may be a first surface, and the thread base may further include a second stop that abuts a second surface on the tab positioned opposite the first surface. The stop may include a ramp surface and a radial surface opposite the ramp surface, and the tab may engage the ramp surface of the stop during installation of the sip ring onto the thread base. The sip ring may be coupled to the thread base by an irreversible bayonet-style coupling. The upper elevator and the lower elevator may be coupled together via a keyed interface. The upper elevator may include a post, and the lower elevator may include a stem at least partially received within the post. The keyed interface may include a notch on the stem and a protrusion on the post. The notch may receive the protrusion. The thread base may include a detent that engages the sip ring to indicate a position of the sip ring relative to the thread base. The thread base may include a follower and the elevator assembly may include a helical track at least partially received by the follower. A D-shaped gasket ring may be positioned between the sip ring and the thread base. The sip ring may define a hollow space. The upper elevator may include a ledge, and the lower elevator may include a finger that snap-fits to the ledge. One of the upper elevator or lower elevator may include a stem and the other of the upper elevator or lower elevator may include a post, and the stem may be at least partially received within the post. A protrusion may be disposed on the post, and the stem may include a notch to receive the protrusion. The sip ring may include a tab having a first end surface, a second end surface, a ramp surface, and a surface extending between the ramp surface and the second end surface. The ramp surface may have a length dimension of at least 2.5 mm, and the first end surface may have a length dimension of greater than or equal to 2.3 mm and less than or equal to 2.5 mm. The ramp surface may be a first ramp surface, and the thread base may include a stop having a second ramp surface. The first ramp surface of the tab may engage the second ramp surface of the stop during installation of the sip ring onto the thread base. The thread base may include a stop having an overall width dimension of at least 2.35 mm.

FIG. 1 illustrates a beverage container assembly 10 having a container 14 and a lid assembly 18 removably coupled to the container 14. In some embodiments, the beverage container assembly 10 may be used to hold liquids, such as, for example, beverages (e.g., water, soda, coffee, etc.). In further embodiments, the beverage container assembly 10 may be used to hold and contain hot liquids (e.g., hot beverages). For example, hot liquids can include liquids that generate steam and/or liquids having a temperature greater than or equal to approximately 71.1 degrees Celsius or greater than or equal to approximately 85 degrees Celsius.

Figure 2:
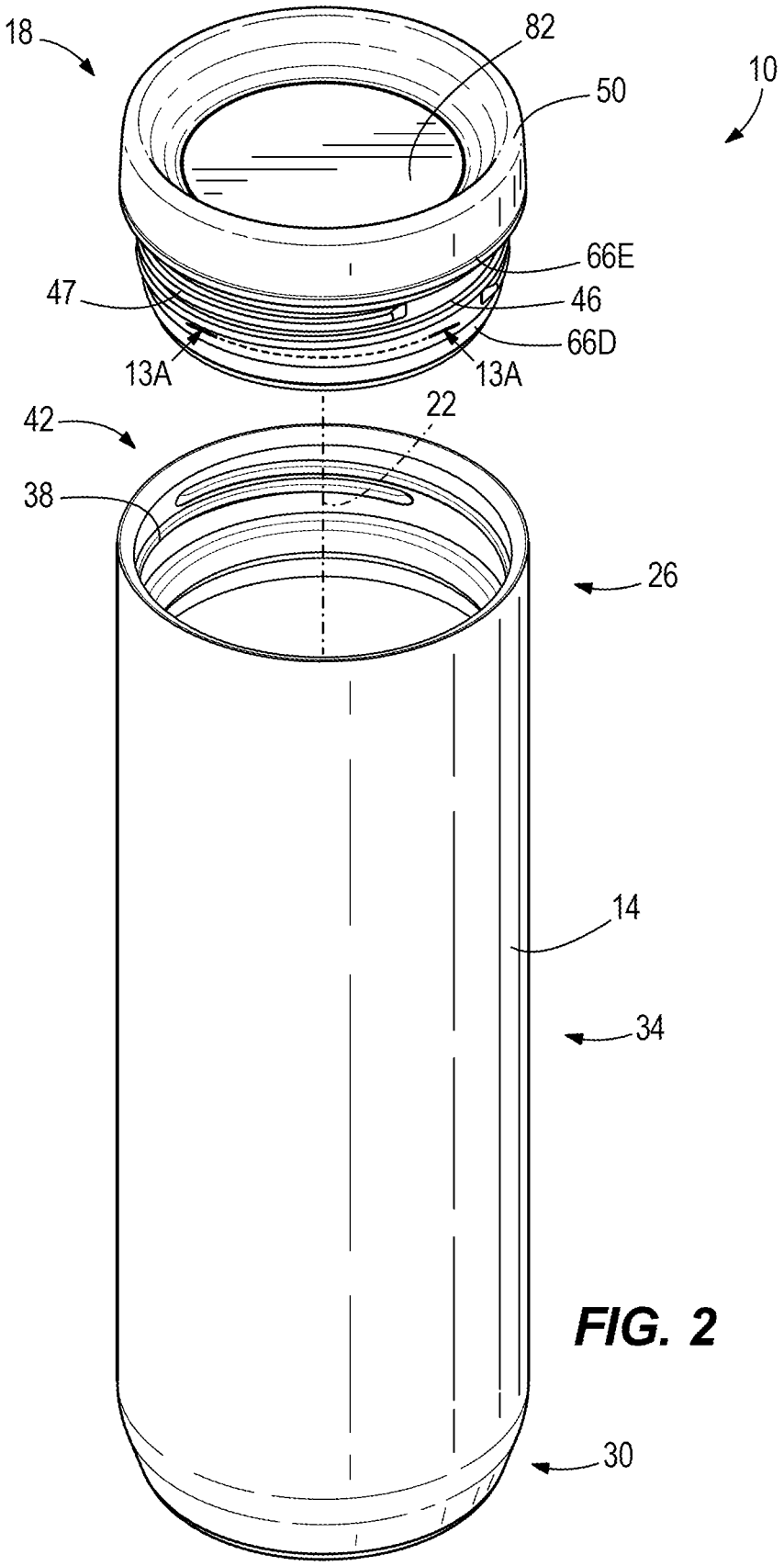
FIG. 2 is an exploded, perspective view of the beverage container assembly of FIG. 1, illustrating a container and a lid assembly.

With reference to FIG. 2, the container 14 can be a hollow body sized and shaped to hold liquids (e.g., beverages). In some embodiments, the container 14 can have a generally elongated, cylindrical shape, although, in other embodiments, the container 14 can have other shapes (e.g., an hourglass-shape, etc.). The container 14 can extend generally symmetrically about an axis 22 (e.g., central axis). The container 14 can have an open top region 26, a closed lower region 30, and a central region 34 defined between the top region 26 and the lower region 30 along the axis 22. The top region 26 can include a series of internal container threads 38, and an upper opening 42 for providing access to an interior of the container 14. The container 14 may be made of metal (e.g., stainless steel, aluminum, etc.), plastic, or any other suitable material. Further, the container 14 can comprise a double-walled, vacuum-formed vessel. In some embodiments, the container 14 can comprise a double-walled, vacuum-formed, stainless steel vessel.

Figure 3:
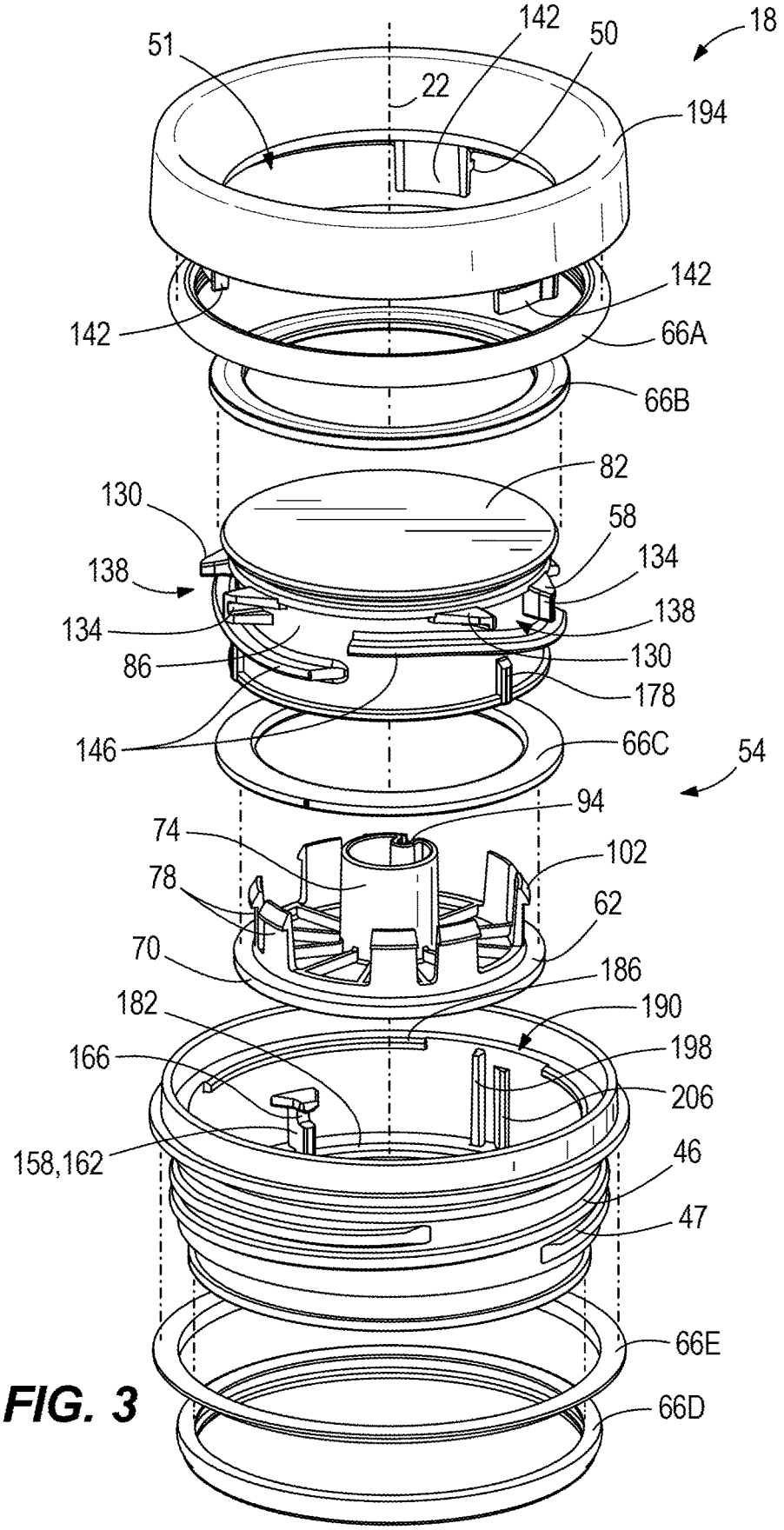
FIG. 3 is an exploded view of the lid assembly of FIG. 2, illustrating a sip ring, an upper elevator, a lower elevator, and a thread base.
Figure 4A:
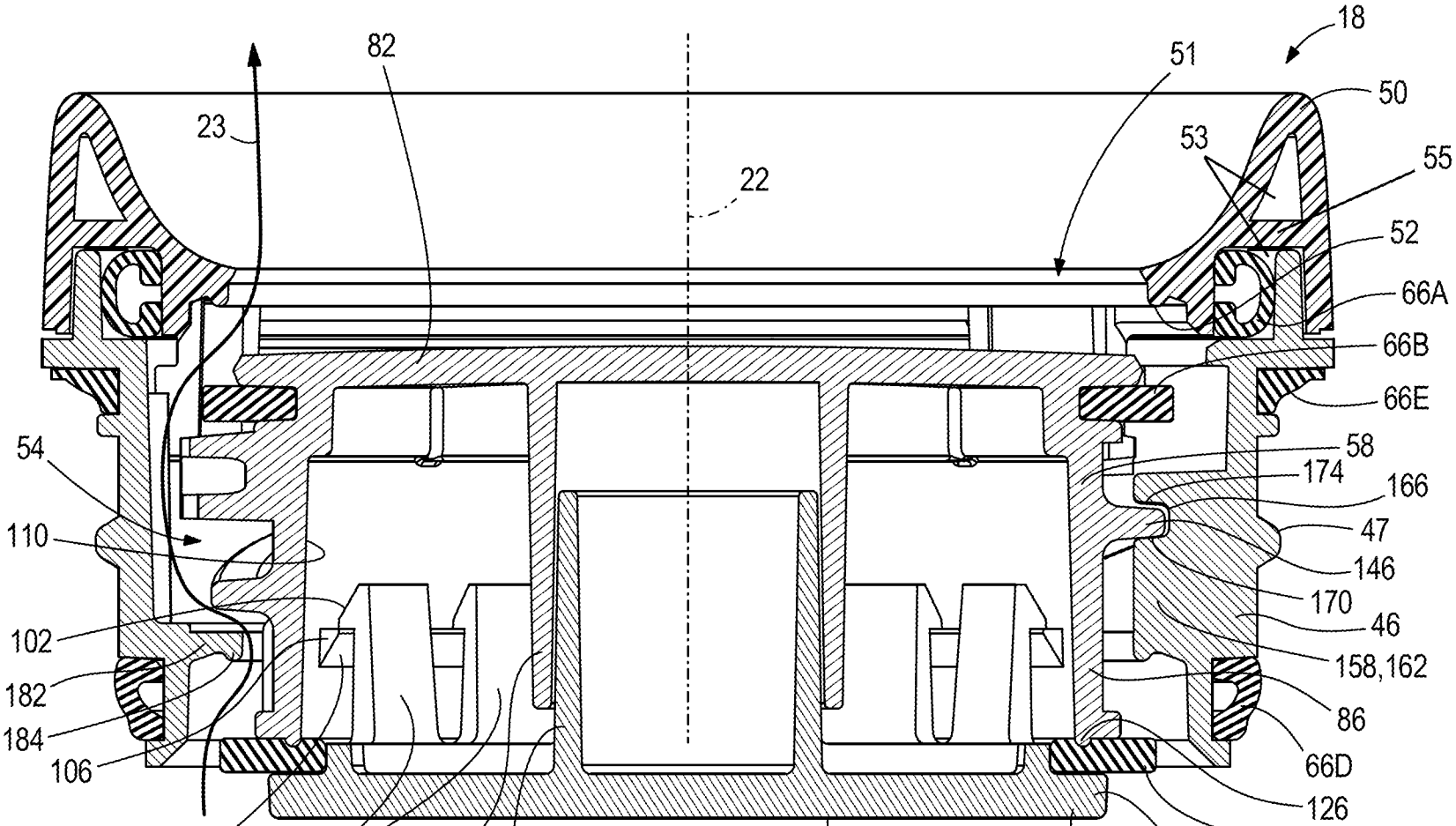
FIG. 4A is a cross-sectional view of the lid assembly of FIG. 2, illustrated in an open position.

With reference to FIG. 3, in the illustrated embodiment the lid assembly 18 includes a thread base 46, a sip ring 50, and an elevator assembly 54. The elevator assembly 54 is a sub-assembly with an upper elevator 58 and a lower elevator 62. The lid assembly 18 can overall be generally cylindrical, and along with the container 14, can define the axis 22. In the illustrated embodiment the thread base 46 includes threads 47 (e.g., external threads) to engage the container threads 38 formed on the container 14, thereby securing the lid assembly 18 to the container 14. The sip ring 50 defines a hollow space 51 in the interior of the sip ring 50. The lid assembly 18 also includes a plurality of seals 66. In the illustrated embodiment, a seal 66A is positioned between the sip ring 50 and the thread base 46, a seal 66B is carried on the upper elevator 58, a seal 66C is positioned between the upper elevator 58 and the lower elevator 62, and two seals 66D, 66E are carried by the thread base 46 to seal against the container 14. In the illustrated embodiment, and with reference to FIG. 4A, the sip ring 50 can be formed by gas assist injection molding. This process can create the hollow space 51 in the interior of the sip ring 50, and/or a hollow space or spaces 53 along the outer perimeter of the sip ring 50 within which the seal 66A is at least partially located. As illustrated in FIG. 4A, the wall thickness of the sip ring 50 is generally constant throughout (e.g., rather than being thicker at the outer perimeter than elsewhere), which can inhibit or prevent deformation and cosmetic defects. Additionally, as seen in FIG. 4A, the sip ring 50 can create an upper wall 55 (e.g., "roof") for the seal 66A at the outer perimeter, which can facilitate better sealing and friction. The sip ring 50 is rotatable by a user about the axis 22 with respect to the thread base 46. Rotation of the sip ring 50 can cause the elevator assembly 54 to translate along the axis 22 between a lid assembly 18 open position (FIG. 4A) and a lid assembly 18 closed position (FIG. 4B), as explained in greater detail below.

Figure 5:
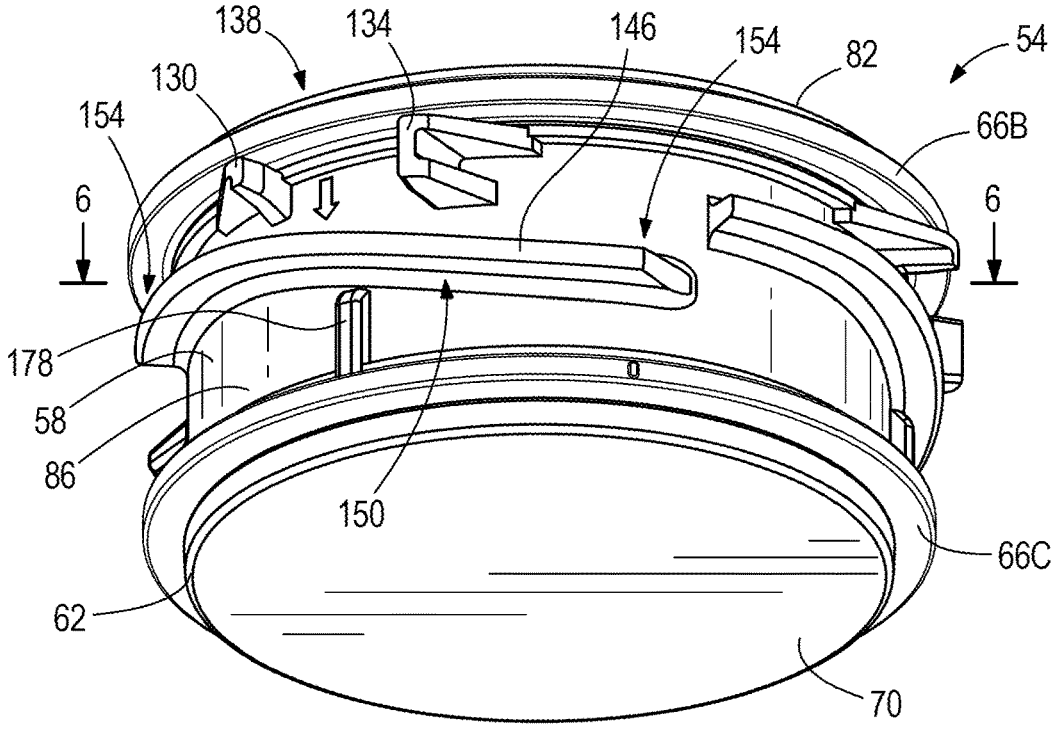
FIG. 5 is a perspective view of an elevator assembly of the lid of assembly of FIG. 2.
Figure 6:
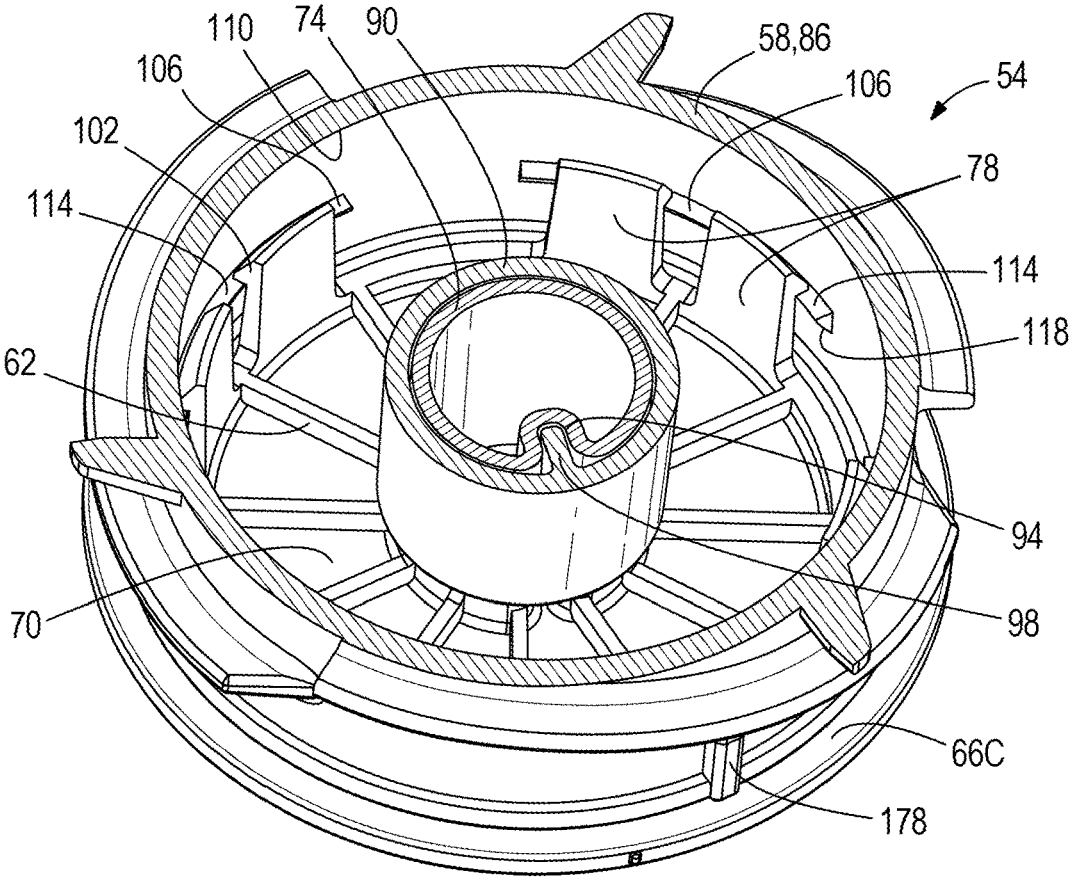
FIG. 6 is a cross-sectional view of the elevator assembly of FIG. 5, taken along lines 6-6 shown in FIG. 5.
Figure 7:
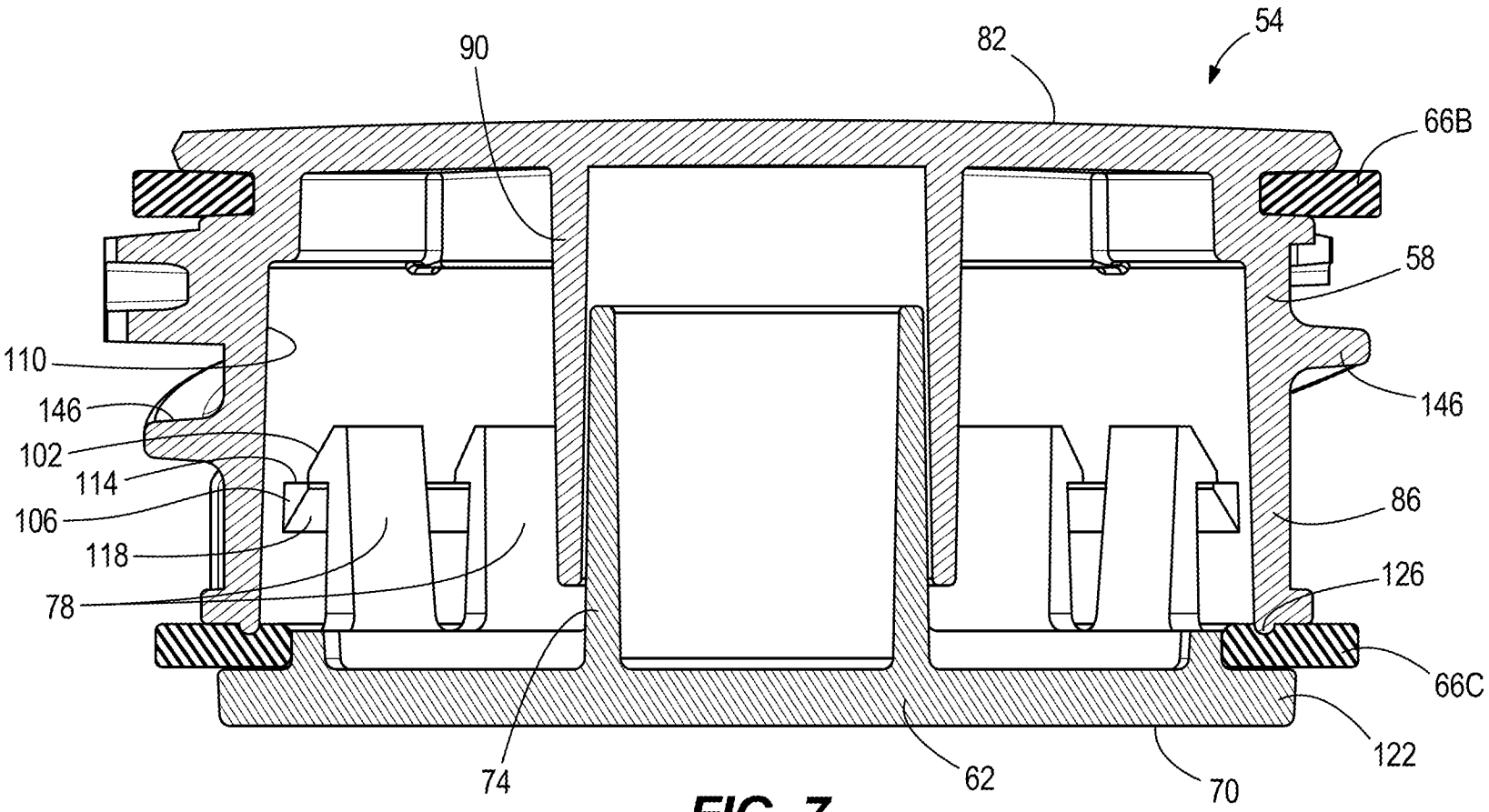
FIG. 7 is a cross-sectional view of the elevator assembly of FIG. 5.

With reference to FIGS. 3 and 5-7, the elevator assembly 54 includes the upper elevator 58 and the lower elevator 62 coupled together. The elevator assembly 54 can be positioned within the thread base 46. The lower elevator 62 includes a bottom, base plate 70 and a stem 74 (e.g., center stem) that extends from the base plate 70. The lower elevator 62 also includes fingers 78 that extend axially from the base plate 70. In the illustrated embodiment, the fingers 78 are positioned radially outward from the stem 74, about an outer circumference of the base plate 70. The upper elevator 58 includes an upper plate 82, a cylindrical body 86, and a post 90 positioned within the cylindrical body 86 (FIG. 7). The post 90 extends from the upper plate 82 (e.g., along the axis 22).

With reference to FIGS. 6 and 7, the stem 74 on the lower elevator 62 can be received within the post 90 of the upper elevator 58. The stem 74 includes a radial notch 94 (FIG. 6) that receives a radial protrusion 98 formed on the post 90. The notch 94 on the lower elevator 62 can receive the protrusion 98 on the upper elevator 58 to form a keyed interface between the upper elevator 58 and the lower elevator 62. In other words, the upper elevator 58 and the lower elevator 62 are coupled together for co-rotation by the notch 94 and the protrusion 98. In other embodiments, the stem 74 is formed on the upper elevator 58 and the post 90 on the lower elevator 62 and the upper elevator 58 is at least partially received within the lower elevator 62. Likewise, in other embodiments, the notch 94 is formed on the upper elevator 58 and the lower elevator 62 includes the corresponding protrusion 98 to form the keyed interface between the upper elevator 58 and the lower elevator 62. In some embodiments, more than one notch 94 and/or protrusion 98 are formed along the upper elevator 58 and/or lower elevator 62 to form the keyed interface. Additionally, in some embodiments the notch 94 and/or protrusion 98 may have a shape or size other than that illustrated.

With reference to FIG. 6, in the illustrated embodiment each finger 78 on the lower elevator 62 includes a hook 102 formed at a terminal end of the finger 78. The upper elevator 58 includes a plurality of ledges 106 formed on an inner surface 110. The ledges 106 each include an upper surface 114 (i.e., approximately perpendicular to the axis 22) and an angled lower surface 118, which combine to form a triangular-shaped inward protrusion. The hooks 102 and the ledges 106 engage to form a snap-fit coupling between the upper elevator 58 and the lower elevator 62. Specifically, the hooks 102 slide past the angled lower surface 118 as the lower elevator 62 and upper elevator 58 move toward each other during installation until the hooks 102 flex radially inwardly and then snap back radially outwardly over the ledge 106 and engage the flat upper surface 114. The seal 66C is positioned and secured between the lower elevator 62 and the upper elevator 58. In the illustrated embodiment, and with reference to FIG. 7, the seal 66C rests on a ledge 122 formed on the lower elevator 62 and is depressed by a ridge 126 formed on the upper elevator 58 once the lower elevator 62 has been snap fitted to the upper elevator 58. The seal 66C can be, for example, a silicone face-style seal.

Figure 5A:
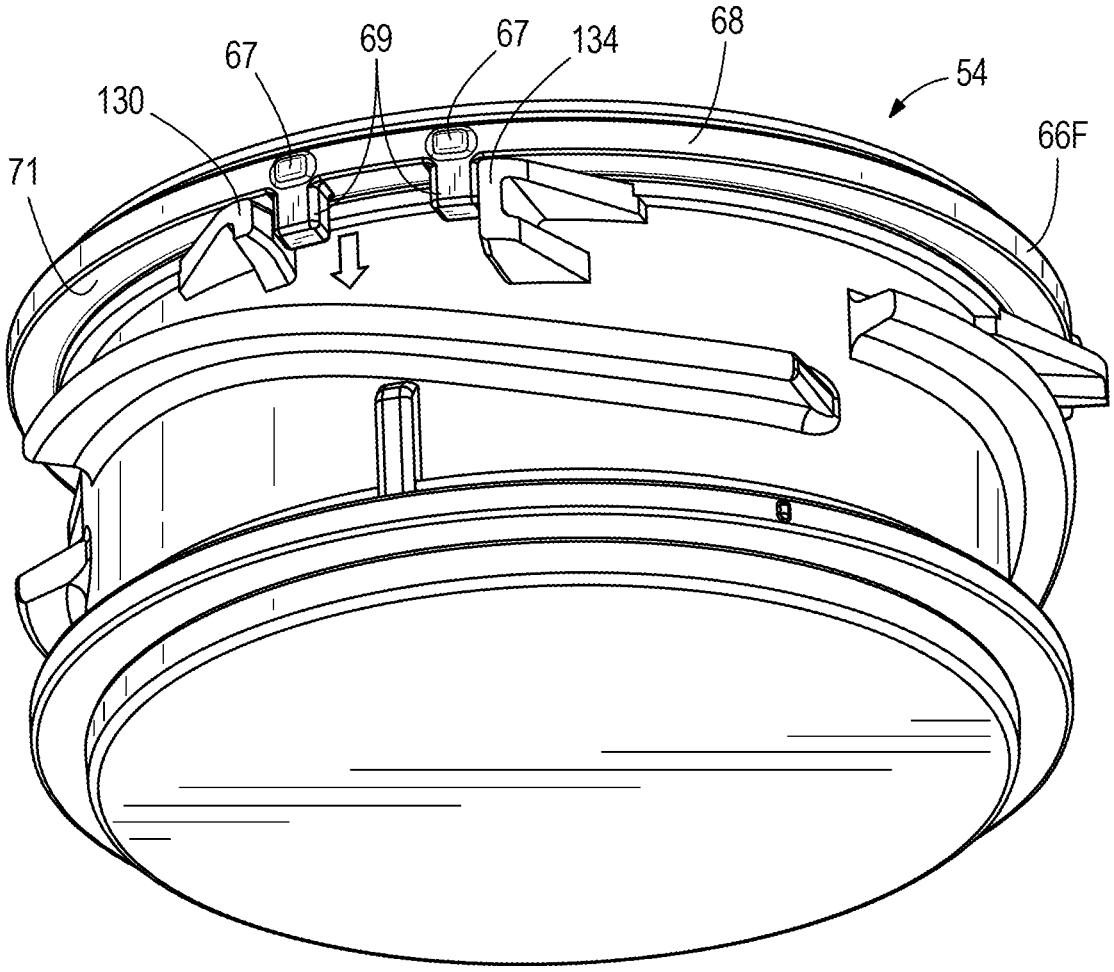
FIG. 5A is a perspective view of an elevator assembly according to another embodiment.
Figure 16:
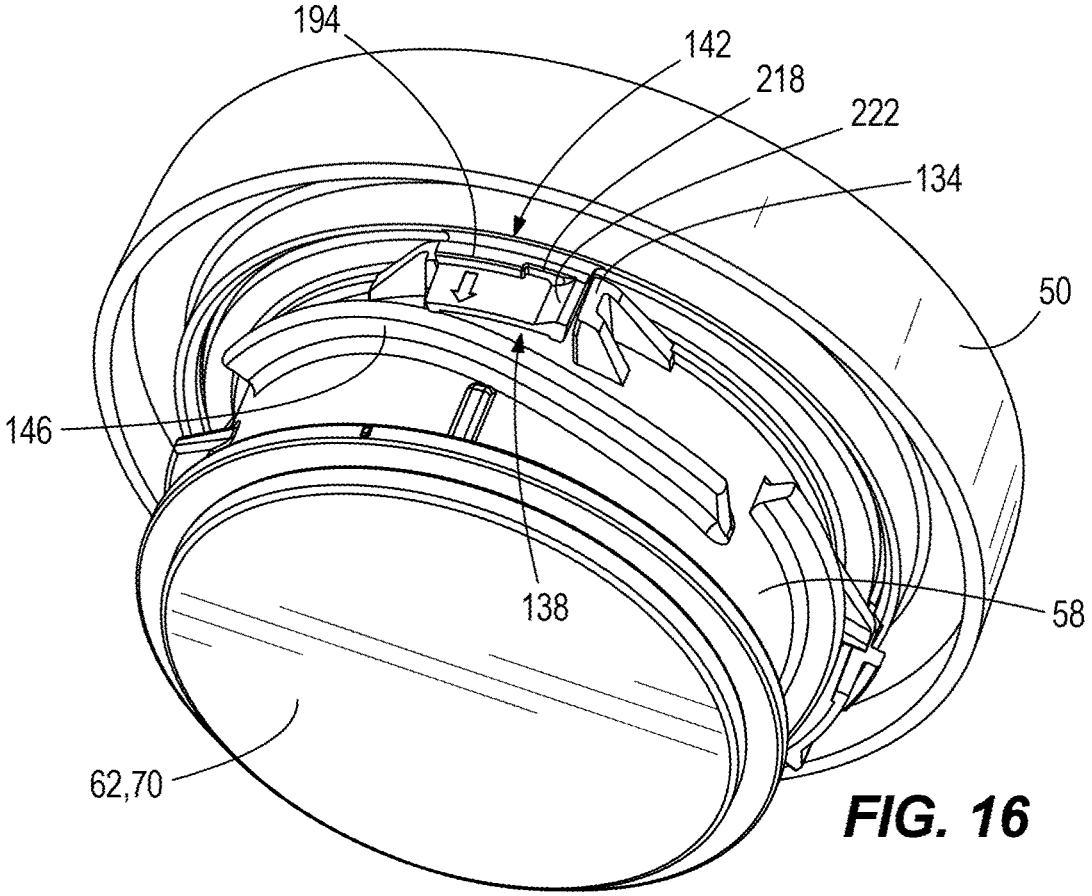
FIG. 16 is a perspective view of the sip ring coupled to the elevator assembly.

With reference to FIG. 5, the upper elevator 58 includes a first fin 130 and a second fin 134 spaced apart from the first fin 130 to form a slot 138 extending therebetween. In the illustrated embodiment, there are three pairs of fins 130, 134, forming three slots 138. The slots 138 receive tabs 142 formed on the sip ring 50 (FIG. 16). When the tabs 142 are positioned within the slots 138, the elevator assembly 54 is coupled to the sip ring 50 for co-rotation with the sip ring 50 about the axis 22. In other words, the tabs 142 on the sip ring 50 are drivingly engaged with the elevator assembly 54. As such, when a user rotates the sip ring 50 the elevator assembly 54 is also rotated about the axis 22. With reference to FIG. 5A, in an alternative embodiment the upper elevator 58 can carry a seal 66F that is similar to the seal 66B. The seal 66F can include standoffs 67 (i.e., bumps) that extend radially from an outer circumferential surface 68 of the seal 66F. The seal 66F can also include tabs 69 that extend axially from a lower surface 71 of the seal 66F. The standoffs 67 and the tabs 69 can aid in positioning the elevator assembly 54 within the thread base 46, and to thereby reduce undesired rattling of the elevator assembly 54 within the thread base 46.

With reference to FIGS. 3 and 5, in the illustrated embodiment the upper elevator 58 also includes tracks 146 that extend from and wrap around the cylindrical body 86. The tracks 146 can be helical or at least partially helical. In the illustrated embodiment, the upper elevator 58 includes three separate tracks 146. In other embodiments, the elevator assembly 54 includes only a single track 146, or two tracks 146, or more than three tracks 146. The tracks 146 can have a variable slope along at least part or all of the length (i.e., the length measured as an arc about the axis 22) of the track 146. For example, and with reference to FIG. 5, the slope of the track 146 may be greater in a middle portion 150 of the track 146 than the slope of the track 146 at end portions 154 of the track 146. The variable slope of the track 146 can determine a rate of axial translation of the elevator assembly 54 for a given rotation of the elevator assembly 54. In the illustrated embodiment, the elevator assembly 54 slowly translates axially around the closed position (FIG. 4A) and the open position (FIG. 4B), but quickly translates axially when moving between the positions. In other embodiments, the tracks 146 can have a constant slope.

Figure 8:
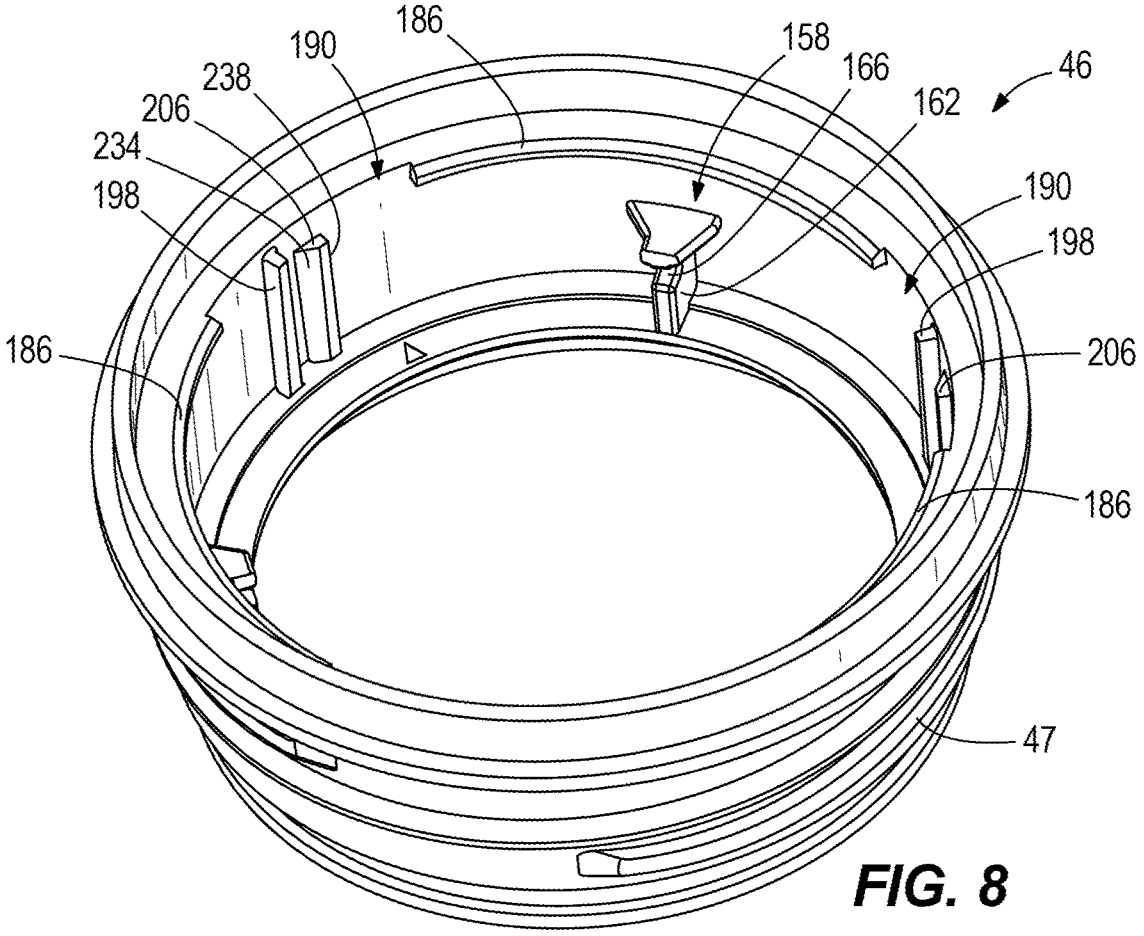
FIG. 8 is a perspective view of the thread base of the lid assembly of FIG. 2.
Figure 9:
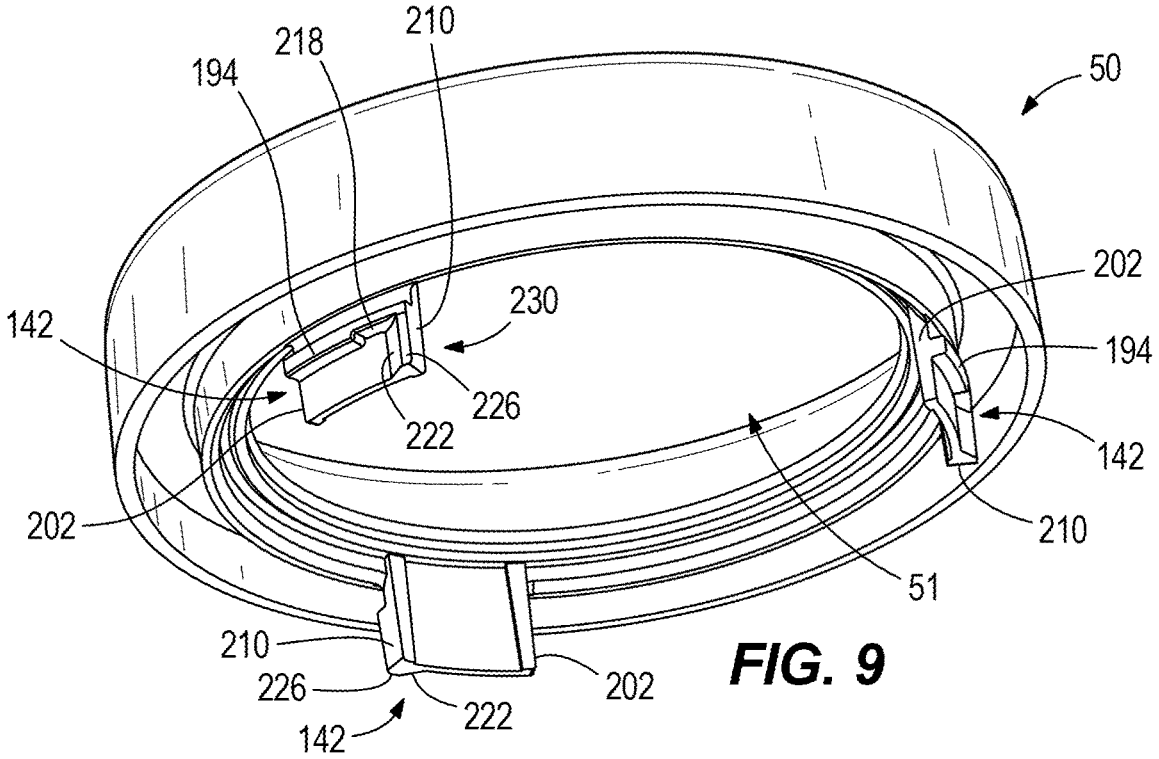
FIG. 9 is a perspective view of the sip ring of the lid assembly of FIG. 2.

With reference to FIG. 8, the tracks 146 are received in followers 158 that are formed on the thread base 46. The followers 158 each include a fin 162 with a notch 166 formed in the fin 162. A portion of the track 146 is received within the notch 166 in the follower 158. A width of the followers 158 can be less than the length of the tracks 146, and in many embodiments, can be sized relative to the length of the tracks 146 to permit the tracks 146 (e.g., the variably sloped portions of the tracks 146) to smoothly move through the followers 158. For example, in some embodiments, the width of the followers 158 can be less than or equal to approximately 6 percent, 4 percent, or 2 percent of the length of the tracks 146. In some embodiments, a number of the followers 158 can be equal to a number of the tracks 146. For example, there can be one of followers 158 for each one of tracks 146. In other embodiments, there can be multiple followers 158 for each one of tracks 146. With reference to FIG. 4A, each notch 166 defines a lower surface 170 and an upper surface 174.

Figure 4B:
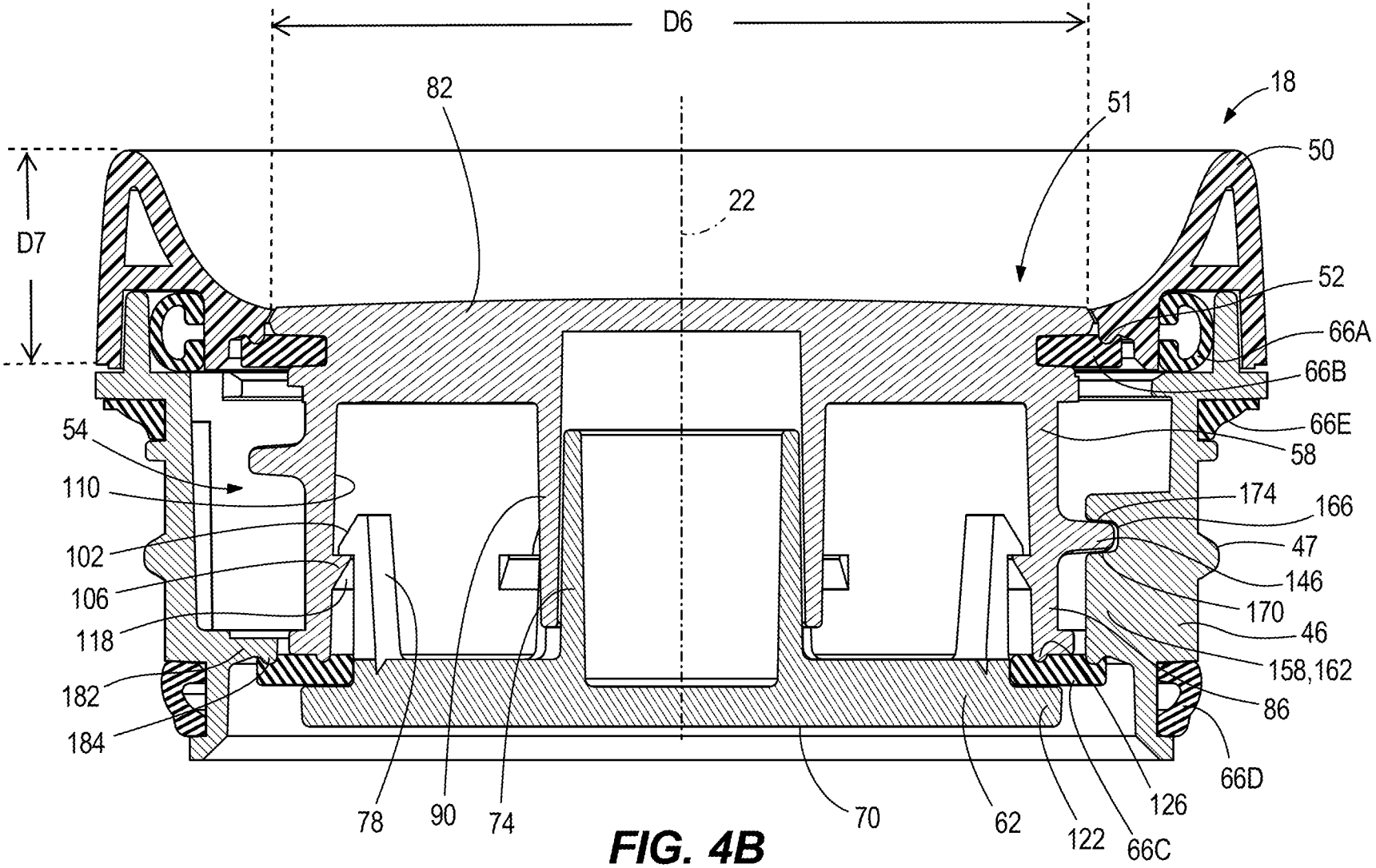
FIG. 4B is a cross-sectional view of the lid assembly of FIG. 2, illustrated in a closed position.

With reference to FIGS. 4A and 4B, during use the user may rotate the sip ring 50, causing the elevator assembly 54 to rotate and the tracks 146 to move within the followers 158. Movement of the tracks 146 within the followers 158 causes the elevator assembly 54 to also translate along the axis 22. As the lid assembly 18 moves between an open position (FIG. 4A) and a closed position (FIG. 4B), the elevator assembly 54 simultaneously rotates about the axis 22 and translates along the axis 22. As the lid assembly 18 moves to the closed position, a force is applied on the lower surface 170 of the notch 166 by the track 146. In the closed position, a ridge 52 formed on the sip ring 50 engages seal 66B, and a ridge 184 formed on the thread base 46 engages the seal 66C to prevent liquid in the container 14 from reaching the sip ring 50. The upper elevator seal 66B and the lower elevator seal 66C prevent spray of the hot beverage within the container when the lid assembly 18 is moved to the open position. In other words, "spray back" that is built up from hot beverages within the container can be eliminated by the positioning of the seals 66B and 66C. Specifically, the lower elevator seal 66C is positioned upstream in the flow pathway 23 (i.e., closest to fluids within the container) and is spaced from the upper elevator seal 66B. In some embodiments, the seal 66C is positioned approximately 19.80 mm (at least approximately 19.80 mm) below a top side of the seal 66B. In other embodiments, the seals 66B, 66C are spaced a different distance apart. The flow pathway 23 includes a tortuous path portion that is positioned between the upper elevator seal 66B and the lower elevator seal 66C, which prevents spray back of hot beverage when opening the sip ring 50 to drink.

To further reduce the amount of spray back, the seals created by seals 66B and 66C are operably broken in a controlled manner. When the container 14 is filled with hot fluids upward pressure is applied on the seals 66B, 66C. It is difficult to break a seal (i.e., to open a seal) by pushing in the opposite direction of the pressure, and if done so, the components opposing the pressure quickly release causing spray back. To prevent this, the end portions 154 of the tracks 146 can be approximately horizontal in the initial stage of opening the lid assembly 14. In other words, the slope of the end portions 154 is less than the slope of the middle portion 150 of the track 146. By moving the seals 66B, 66C in a generally horizontal manner first and then slowly moving the seals 66B, 66C opposite of the pressure within the container 14 along the axis 22, there is a controlled opening of the lid assembly 14 that eliminates potential spay back. Further detail on the operation of the lid assembly 18 is provided below.

Figure 17:
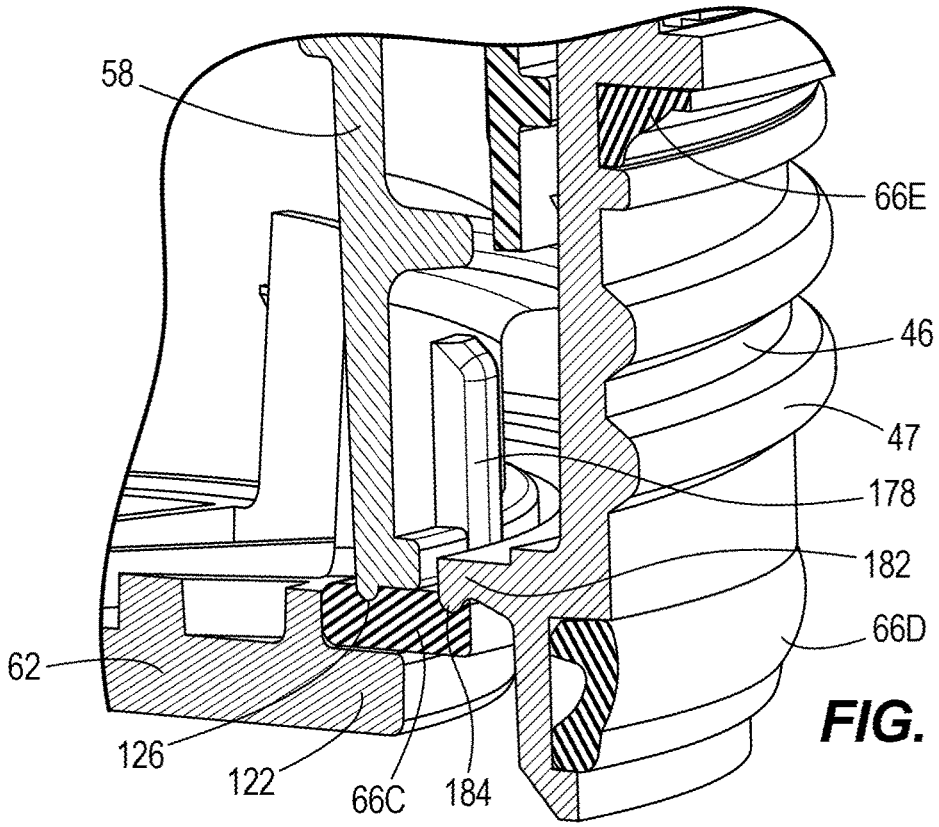
FIG. 17 is a partial, perspective cross-sectional view of the lid assembly of FIG. 2.

With reference to FIGS. 5 and 17, in some embodiments the upper elevator 58 can include radial fins 178 that engage the thread base 46 when the lid assembly 18 is assembled. Specifically, the fins 178 can contact a lower ledge 182 formed on the thread base 46. The fins 178 can aid in positioning and aligning the elevator assembly 54 relative to the thread base 46. As illustrated in FIG. 17, the lower ledge 182 can also include the ridge 184 that engages the seal 66C in the closed position.

Figure 10:
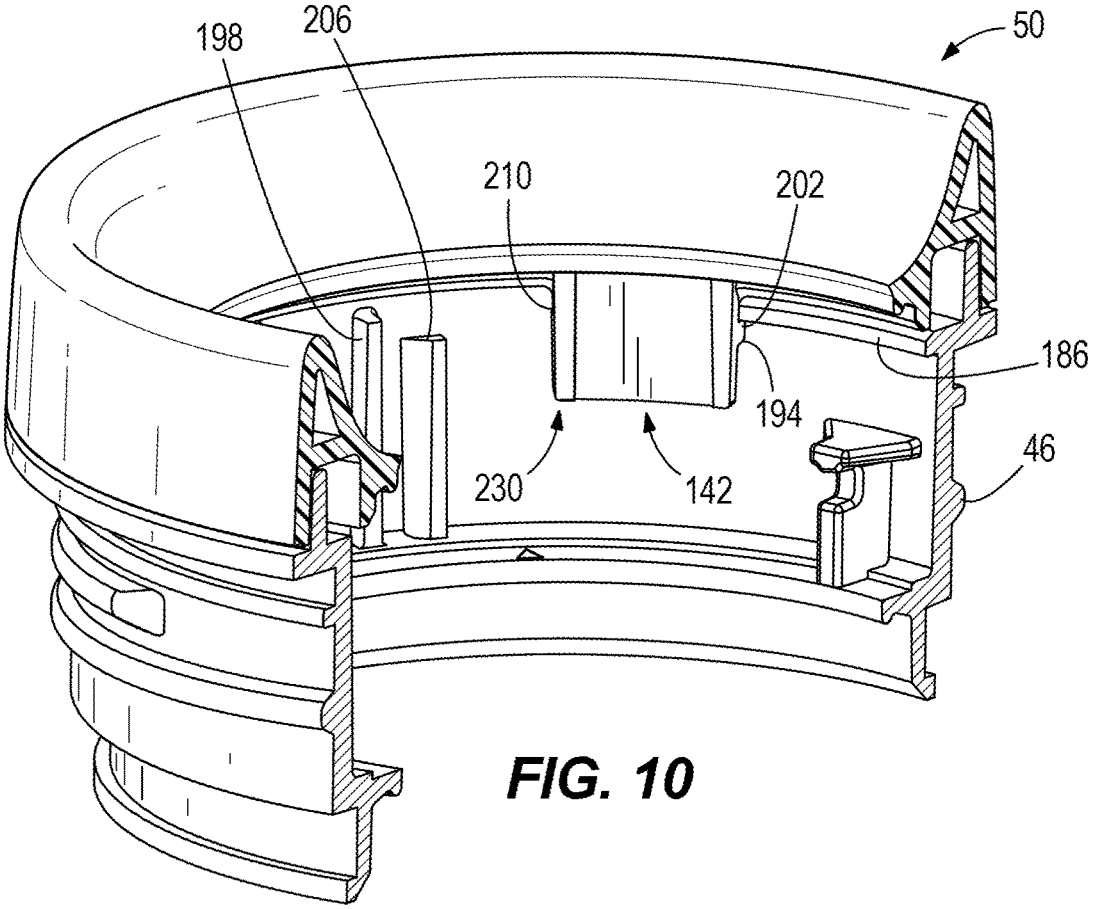
FIG. 10 is a perspective cross-sectional view of the thread base of FIG. 8 and the sip ring of FIG. 9 coupled together.
Figure 11:
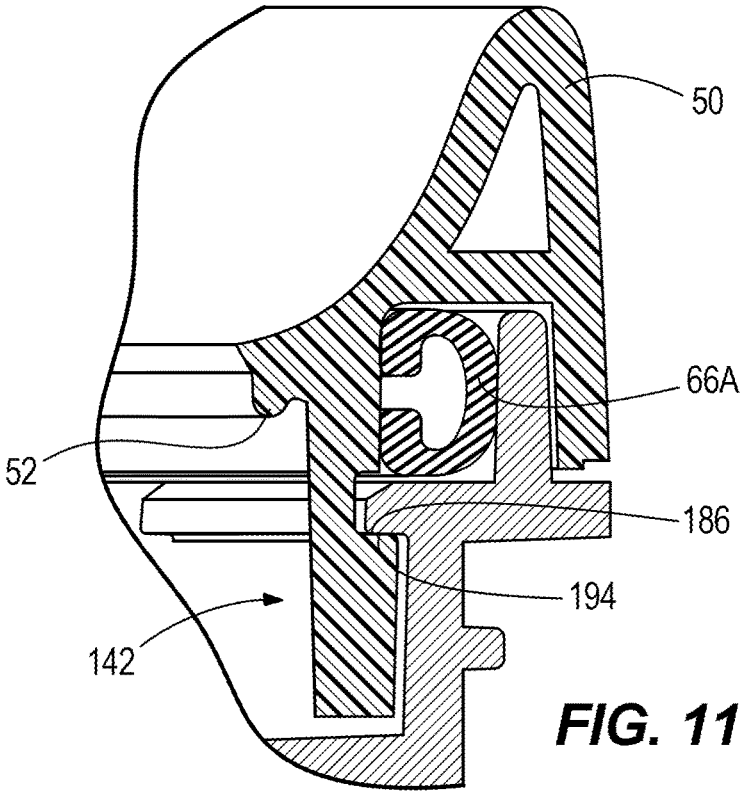
FIG. 11 is an enlarged, partial cross-sectional view of the lid assembly of FIG. 2.

With reference to FIGS. 8-11, the sip ring 50 is rotatable relative to the thread base 46 about the axis 22. In other words, the sip ring 50 rotates relative to the thread base 46. The thread base 46 includes ledges 186 to engage tabs 142 formed on the sip ring 50 to inhibit removal of the sip ring 50 from the thread base 46 while permitting rotation of the sip ring 50 relative to the thread base 46. The sip ring 50 may be secured to the thread base 46 by an irreversible coupling (e.g., bayonet-style coupling). For example, in the illustrated embodiment a notch 190 is formed adjacent each of the ledges 186, and the notch 190 initially receives one of the tabs 142 formed on the sip ring 50. In other embodiments, the coupling can be a reversible coupling. With reference to FIGS. 10 and 11, a rail 194 formed on the tab 142 is positioned under the ledge 186 thereby inhibiting axial removal of the sip ring 50 from the thread base 46 while permitting rotation of the sip ring 50. In other words, as the sip ring 50 rotates with respect to the thread base 46 the rail 194 rotates along the ledge 186. The rail 194 on the tab 142 can extend partially around the axis 22 (i.e., the rail 194 forms an arc). With reference to FIG. 11, the seal 66A is positioned between the sip ring 50 and the thread base 46. The seal 66A can be a gasket ring (e.g., D-shaped or other shaped gasket ring).

In the illustrated embodiment the D-shape of the seal 66A can be advantageous for a number of reasons. For example, the D-shape can provide significant sealing due to the "bullnose" style of its surface contact with the wall of the thread base 46. In some embodiments, and as illustrated, the D-shaped seal 66A can be hollowed out to provide for flexible sealing at four different points of contact between the D-shaped seal 66A and the surrounding components. During use, the sip ring 50 can be gripped for adjustment, and because of the added outside force which varies by the user, the seal 66A can adapt to the different conditions of varying forces being applied. The D-shape seal 66A can also provide a targeted "restrictive force" for adjusting the sip ring 50 during opening and closing. For example, in some embodiments, there can be a target range of 4-7 lbs (17.79-31.14 Newtons) of force in which the user is to apply to adjust the sip ring 50. Too low of a force can result in improper sealing and leaking, and the sip ring 50 can be accidently opened. In contrast, too much force (e.g., greater than 7 lbs (31.14 Newtons)) can result in accidentally unthreading of the entire lid. Other embodiments can include different target ranges of force.

Figure 12:
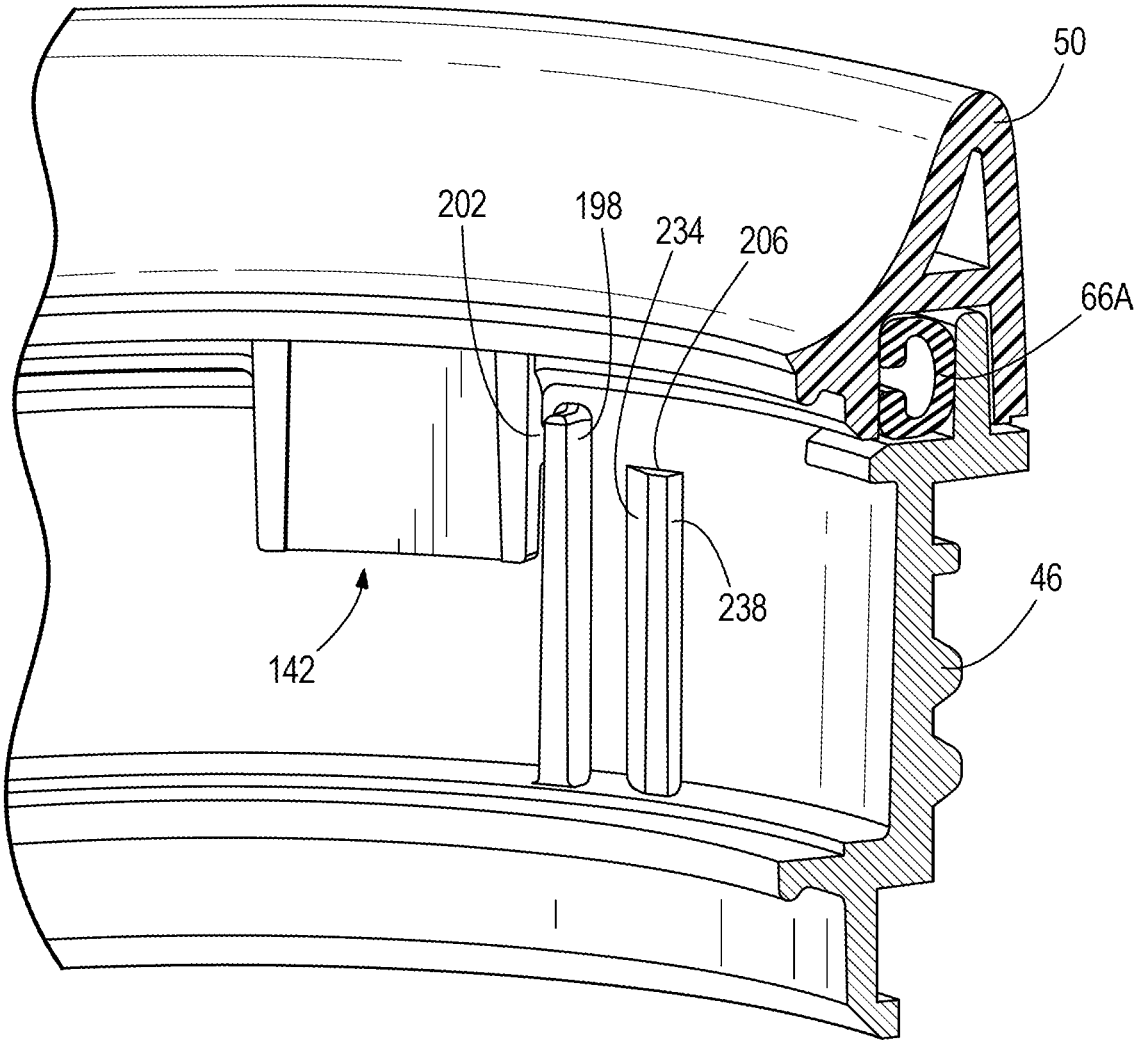
FIG. 12 is a partial tear-away view of the lid assembly of FIG. 2, illustrating the sip ring abutting a stop formed on the thread base.
Figure 15A:
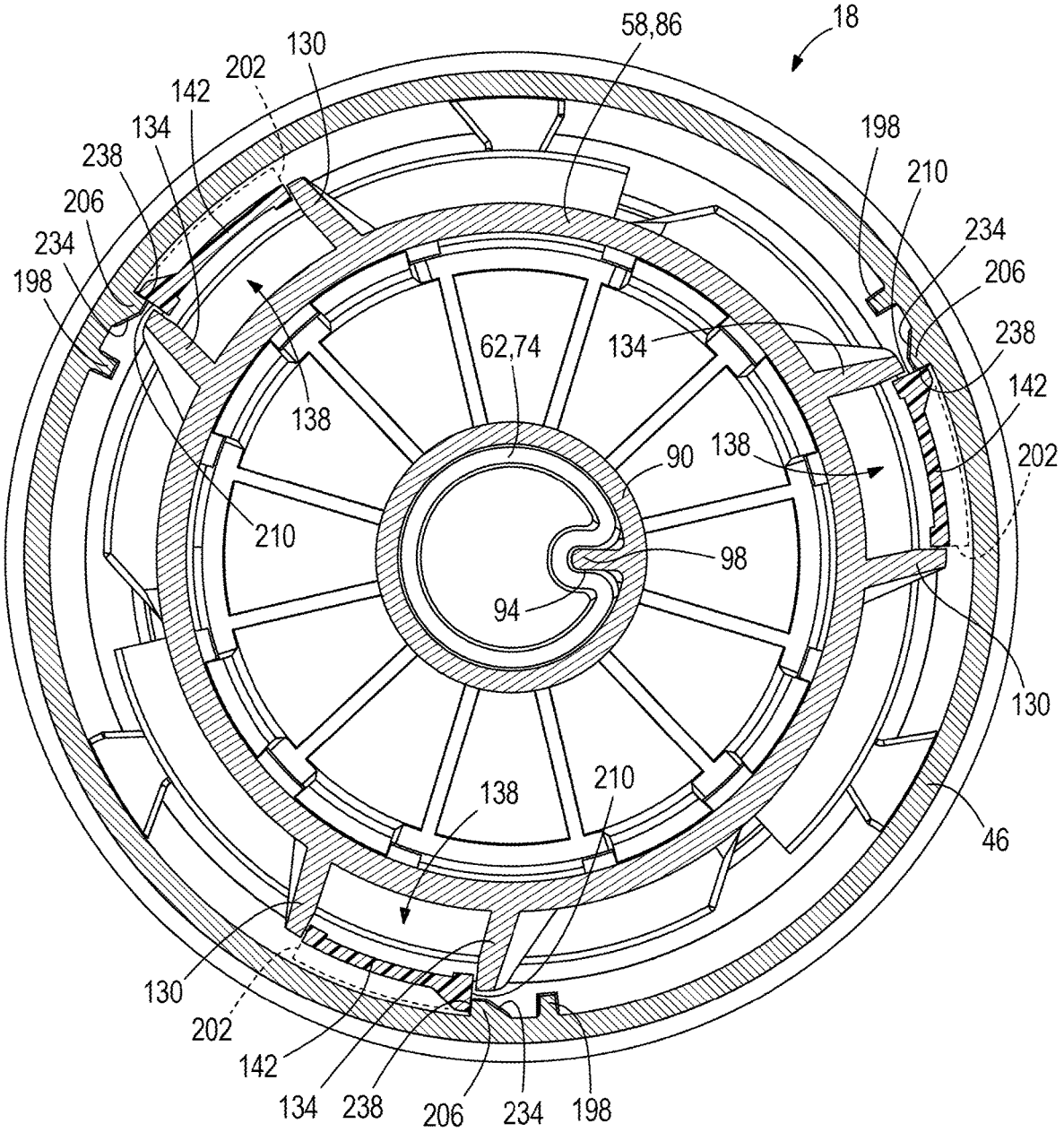
FIG. 15A is a cross sectional view of the lid assembly of FIG. 2, illustrating an opened position.
Figure 15B:
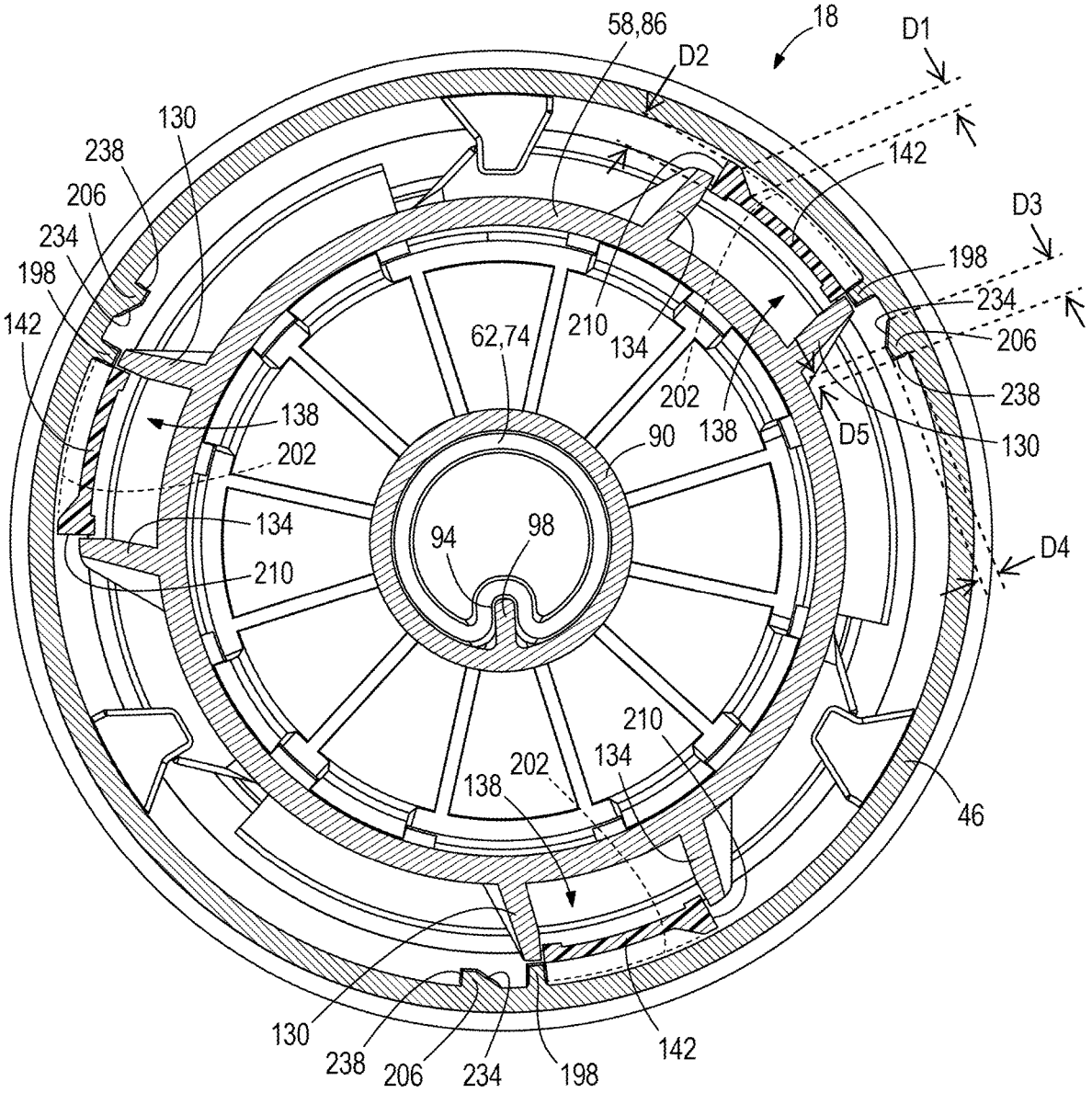
FIG. 15B is a cross-sectional view of the lid assembly of FIG. 2, illustrating a closed position.

With reference to FIG. 12, the thread base 46 also includes a first stop 198 that engages a first end surface 202 (FIG. 10) of the tab 142 to inhibit further rotation of the sip ring 50 when the lid assembly 18 has reached the closed position (FIG. 15B). In other words, the first stop 198 defines the end of permittable rotational travel of the sip ring 50 in the closing direction. Similarly, the thread base 46 includes a second stop 206 that engages a second end surface 210 of the tab 142 to inhibit further rotation of the sip ring 50 when the lid assembly 18 has reached the open position (FIG. 15A). In other words, the second stop 206 defines the end of permittable rotational travel of the sip ring 50 in the opening direction. The second end surface 210 on the tab 142 is opposite the first end surface 202.

Figure 10A:
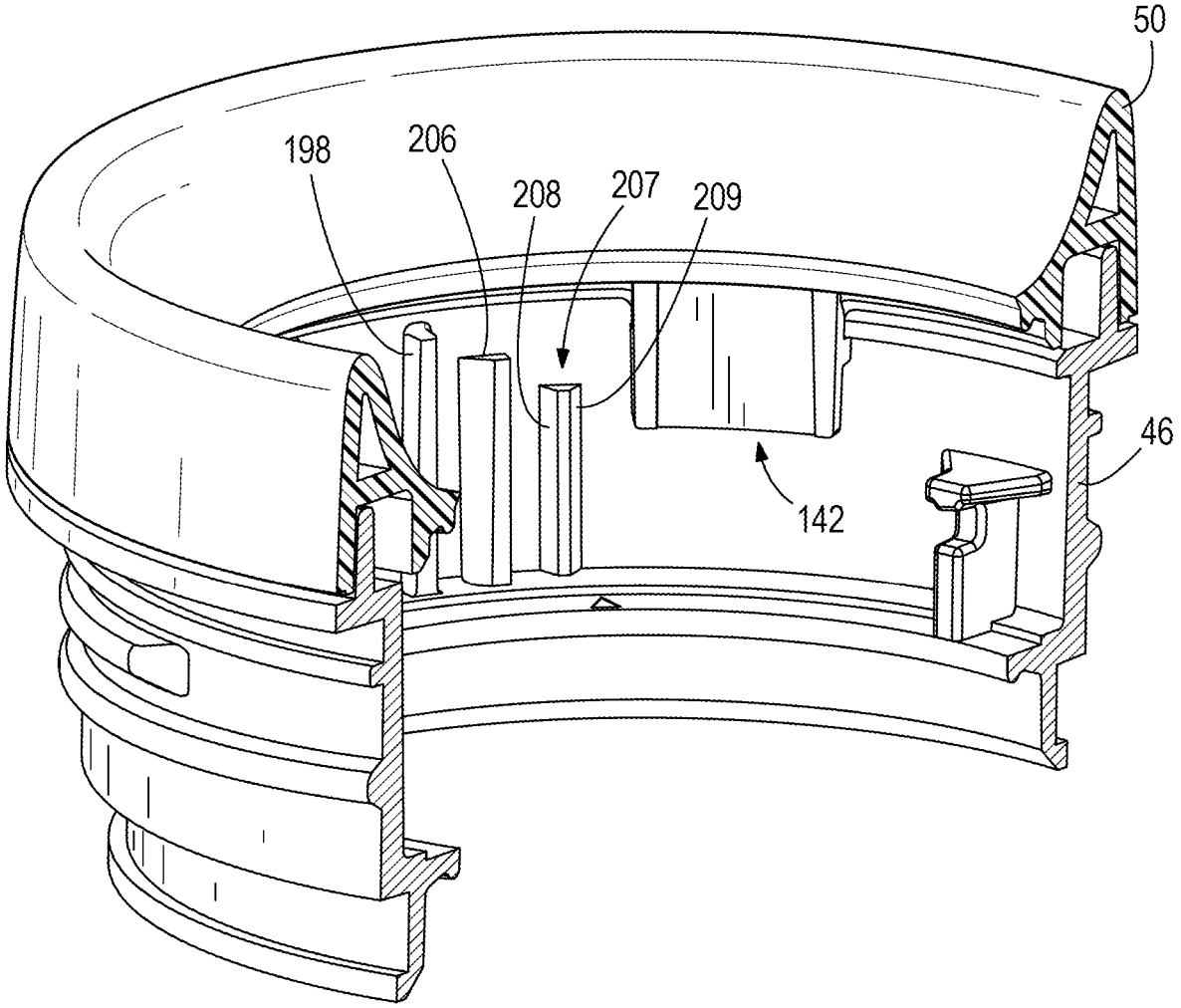
FIG. 10A is a perspective cross-sectional view of a thread base according to another embodiment.

With reference to FIG. 10A, in some embodiments the thread base 46 can include a detent 207 configured to engage the tab 142 on the sip ring 50. The detent 207 includes a first ramp surface 208 and a second ramp surface 209 to permit the tab 142 to pass over the detent 207 in both rotational directions. As the user rotates the sip ring 50, the tab 142 slides over the detent 207 and provides tactical feedback to the user. The tactical feedback from the detent 207 can indicate to the user when the sip ring 50 is approaching either the fully open position (FIGS. 4A and 15A) or the fully closed positioned (FIGS. 4B and 15B). In other words, the detent 207 is positioned to engage the sip ring 50 to indicate a position of the sip ring 50 relative to the thread base 46. In other embodiments, the detent 207 can be omitted.

Figure 13A:
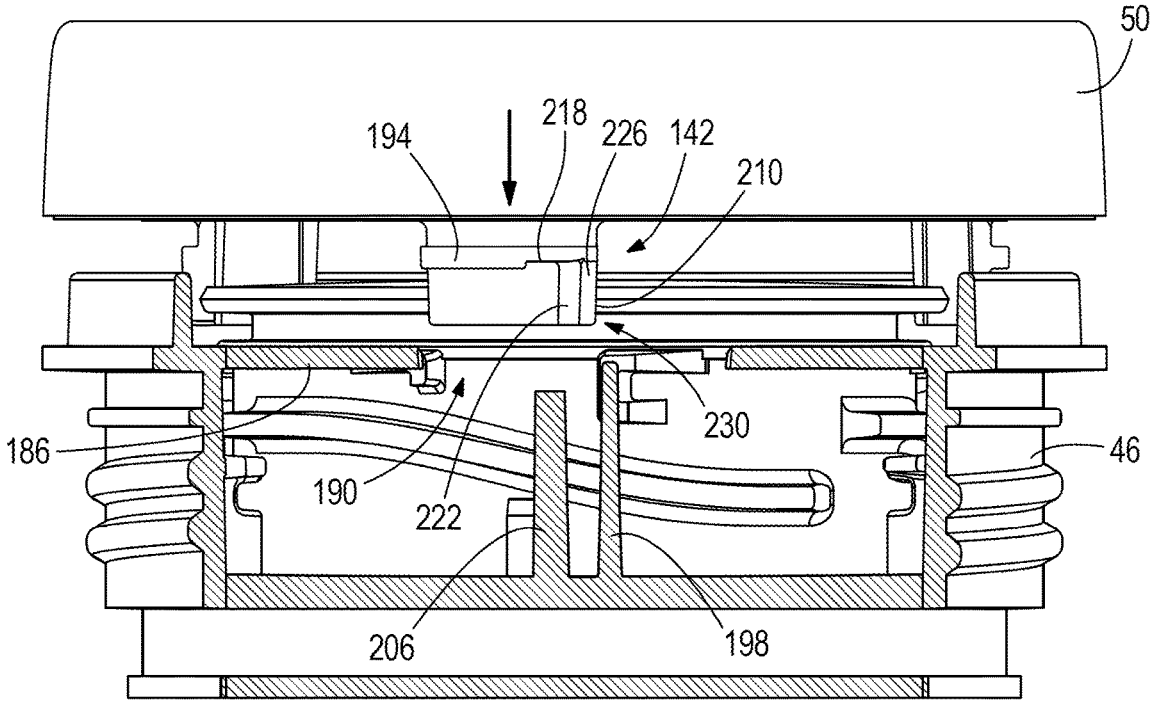
FIG. 13A is a partial tear-away view of the lid assembly of FIG. 2, illustrating the sip ring prior to installation.
Figure 13B:
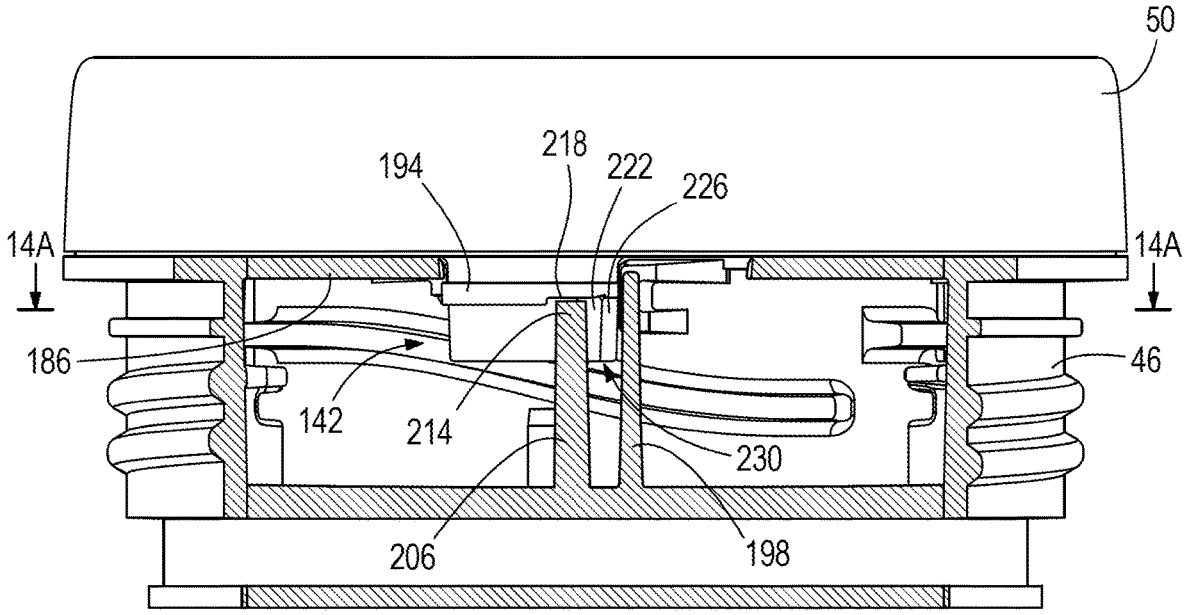
FIG. 13B is a partial tear-away view of the lid assembly of FIG. 2, illustrating the sip ring seated on the thread base.

With reference to FIGS. 13A, 13B, 14A, and 14B, and as described above, the sip ring 50 can be installed and coupled to the thread base 46 by an irreversible bayonet-style coupling. With the bayonet style coupling, the sip ring 50 is oriented such that the tabs 142 are aligned with the notches 190 formed adjacent to the ledge 186 on the thread base 46 (FIG. 13A). With the tabs 142 aligned with the notches 190, the sip ring 50 can be axially inserted into the thread base 46 (FIG. 13B). With the sip ring 50 inserted into the thread base 46, the sip ring 50 is in a ready position (FIG. 13B). In the ready position, the sip ring 50 can be axially removed from the thread base 46. A portion 214 of the second stop 206 abuts the rail 194 when the sip ring 50 is in the ready position (FIG. 13B). The rail 194 can include a notch 218 to receive the portion 214 in the ready position, thereby permitting rotation of the sip ring 50 in only one direction (i.e., the desired install direction) and blocking rotation of the sip ring 50 in the opposite rotational direction. In other embodiments, the coupling can be a reversible coupling.

Figure 14A:
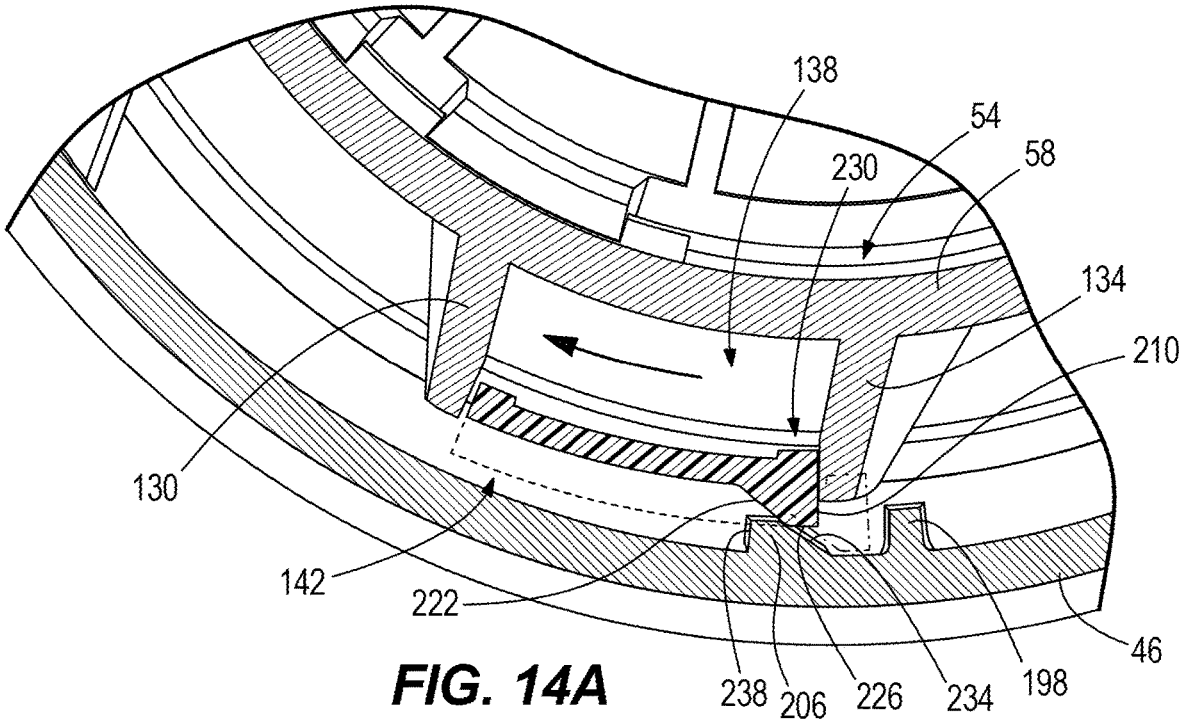
FIG. 14A is a partial cross-sectional view taken along lines 14A-14A shown in FIG. 13B, illustrating a tab of the sip ring sliding over a stop formed on the thread base during installation.
Figure 14B:
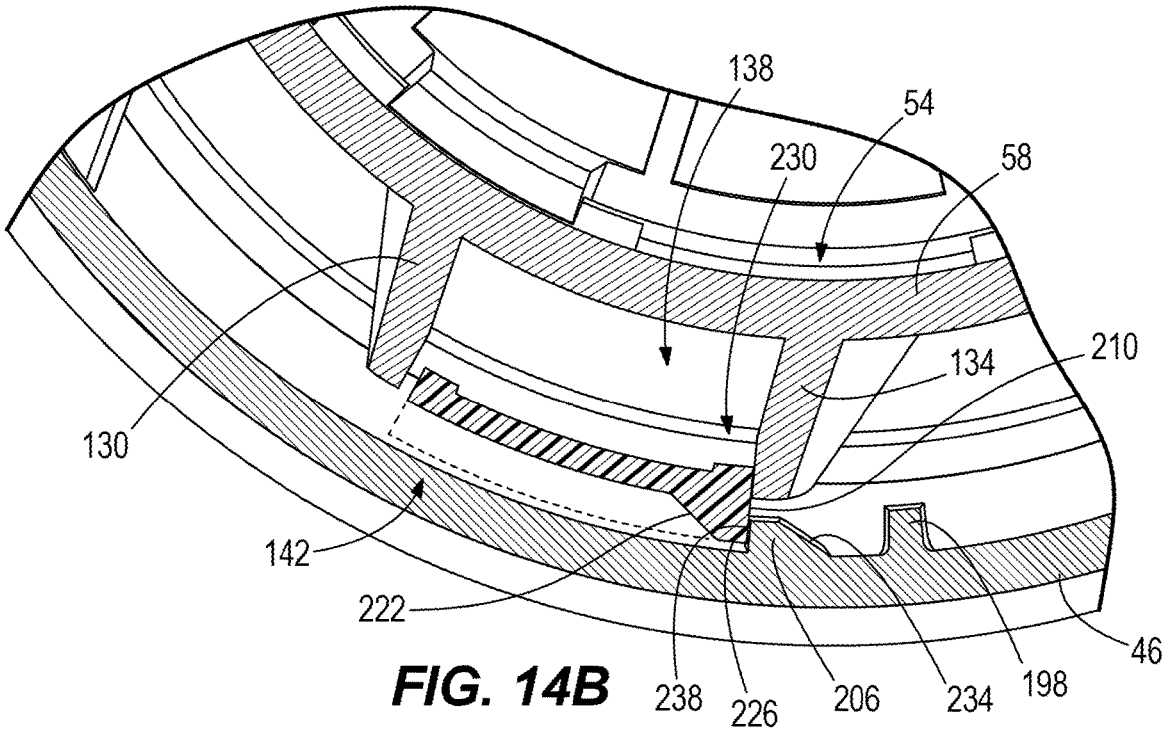
FIG. 14B is a partial cross-sectional view taken along lines 14A-14A shown in FIG. 13B, illustrating the sip ring abutting the stop formed on the thread base.

With continued reference to FIGS. 13A, 13B, 14A, and 14B, the tab 142 includes a ramp surface 222, with a surface 226 extending between the ramp surface 222 and the second end surface 210. The ramp surface 222 and the surface 226 form a protrusion 230 on the tab 142. When the sip ring 50 is in the ready position, the ramp surface 222 and the surface 226 are positioned between the first stop 198 (i.e., the closed stop) and the second stop 206 (i.e., the open stop). From the ready position, the sip ring 50 is rotated in the direction permitted by the notch 218. With reference to FIG. 14A, the ramp surface 222 on the tab 142 engages a ramp surface 234 formed on the second stop 206, allowing the tab 142 to slide past the second stop 206 one-way. The tab 142 deflects radially inward as the ramp surface 222 slides past the stop 206. Once the tab 142 clears the second stop 206, the tab 142 deflects radially outward into an installed position. Once in the installed position, the second end surface 210 abuts a radial surface 238 of the second stop 206 to define an extent of travel for the sip ring 50 during operation and the sip ring 50 is not permitted to return to the ready position (FIG. 13B). The radial surface 238 is positioned opposite the ramp surface 234. In other words, the sip ring 50 is coupled to the thread base 46 by an irreversible bayonet-style coupling. In other embodiments, the coupling can be a reversible coupling.

With reference to FIG. 15B, in some embodiments the ramp surface 222 of the tab 142 has a length dimension D1, and the second end surface 210 of the tab 142 has a length dimension D2. The length dimension D1 can, for example, be at least 2.5 mm (e.g., 2.5 mm, 2.6 mm, 2.7 mm, 2.8 mm, greater than or equal to 2.5 mm and less than or equal to 5 mm, etc.). The length dimension D2 can, for example, be greater than or equal to 2.3 mm and less than or equal to 2.5 mm. With continued reference to FIG. 15B, in some embodiments the second stop 206 has an overall width dimension D3 of at least 2.35 mm (e.g., 2.35 mm, 2.4 mm, 2.5 mm, greater than or equal to 2.35 mm and less than or equal to 5 mm, etc.). The radial surface 238 of the second stop 206 also has an overall length dimension D4 of greater than or equal to 0.95 mm and less than or equal to 1.0 mm. As illustrated in FIG. 15B, the second stop 206 also has a face positioned between the ramp surface 234 and the radial surface 238 that has a length dimension D5 of at least 0.91 mm (e.g., 0.91 mm, 0.95 mm, 1.0 mm, etc.). In the illustrated embodiment implementing the dimensions described above can be advantageous because of their ability to resist heat deflection. Other embodiments, however, can include different values and ranges.

With reference to FIG. 4B, in some embodiments the lid assembly 18 can provide 360 sipping (i.e., the user may drink from anywhere around the lid). The lid assembly 18 includes a dimension D6 (e.g., an inner diameter of sip ring 50) that facilitates this 360 sipping and inhibits spilling. In the illustrated embodiment, for example, the dimension D6 is 51.00 mm, although other embodiments include different values and ranges (e.g., 48 mm, 50 mm, 52 mm, 54 mm, etc.). It has been found that the 51.00 mm opening can provide the user with a more controlled flow when tilting the bottle to drink (e.g., a flow of liquid into the mouth that is no more than 10 mm wide). Additionally, the slope and height of the sip ring 50 can be related to the dimension D6, and also affect spilling of liquid. The amount of required engagement the user has for his or her mouth to naturally drink is minimized and achieved by D6 and also a dimension D7, as this relationship is symbiotic to get a desired control of flow and ease of use. If D7 is too tall, then the travel of fluid to mouth is too great and would require the user to "unnaturally" engage more of his or her mouth onto the sip ring 50 to prevent spilling. In the illustrated embodiment D7 is 13.6 mm, although other embodiments can include different values and ranges (e.g., 13 mm, 14 mm, between 12-15 mm, etc.).

In operation, the lid assembly 18 moves between the open position (FIGS. 4A and 15A) in which liquid within the container 14 is accessible at the sip ring 50 and the closed position (FIGS. 4B and 15B) in which the liquid within the container 14 is sealed within the container 14. Specifically, liquid within the container 14 flows through a pathway 23 to be accessible by a user when the lid assembly 18 is in the open position (FIG. 4A). The user rotates the sip ring 50 relative to the thread base 46, which is secured to the container 14, thereby causing the elevator assembly 54 to simultaneously rotate about and translate along the axis 22.

In some embodiments, the assembly order of the lid assembly 18 may include at least the following sequential steps: (Step 1) position a seal (e.g., seal 66B) onto the upper elevator 58; (Step 2) position seals (e.g., seals 66D, 66E) onto the thread base 46; (Step 3) align and insert upper elevator 58 into thread base 46; (Step 4) rotate the upper elevator 58 slightly to engage the track 146 into the follower 158; (Step 5) position a seal (e.g., seal 66A) onto the sip ring 50; (Step 6) place the sip ring 50 into the thread base 46 and upper elevator 58 simultaneously; (Step 7) rotate the sip ring 50 to slide over a one-way snap (e.g., ramp surface 234 and second stop 206); (Step 8) position a seal (e.g., seal 66C) on the lower elevator 62; and (Step 9) snap lower elevator 62 onto upper elevator 58. In other embodiments, one or more of the steps may be re-ordered or eliminated.

Various features of the disclosure are set forth in the following claims.

The invention claimed is:

1. A lid assembly configured to be coupled to a beverage container, the lid assembly comprising:

a thread base defining an axis;

a sip ring rotatable about the axis with respect to the thread base; and an elevator assembly configured to be coupled to the sip ring, wherein the elevator assembly includes an upper elevator and a lower elevator, wherein the lower elevator is configured to be coupled to the upper elevator for co-rotation with the upper elevator;

wherein rotation of the sip ring is configured to cause the elevator assembly to translate along the axis relative to the thread base;

wherein the thread base includes a first, radially-inwardly protruding stop configured to limit rotation of the sip ring about the axis in a closing direction and a second, radially-inwardly protruding stop configured to limit rotation of the sip ring about the axis in an opening direction.

2. The lid assembly of claim 1, wherein the thread base includes a follower and the elevator assembly includes a track configured to be at least partially received by the follower.

3. The lid assembly of claim 2, wherein the track has a variable slope along a length of the track.

4. The lid assembly of claim 1, wherein the elevator assembly includes a first seal and a second seal axially spaced along the axis from the first seal, wherein in a closed position of the lid assembly, the first seal is configured to seal the elevator assembly to the sip ring and the second seal is configured to seal the elevator assembly to the thread base.

5. The lid assembly of claim 4, wherein a tortuous flow path is positioned between the first seal and the second seal.

6. The lid assembly of claim 1, wherein the elevator assembly is configured to be coupled to the sip ring for co-rotation with the sip ring about the axis.

7. The lid assembly of claim 6, wherein the elevator assembly includes a slot, and wherein the sip ring includes a tab that is configured to be received within the slot.

8. The lid assembly of claim 7, wherein the tab includes a rail that is configured to extend partially around the axis.

9. The lid assembly of claim 8, wherein the thread base includes a stop that is configured to abut a surface of the tab.

10. The lid assembly of claim 9, wherein the stop is a first stop and the surface is a first surface, and wherein the thread base further includes a second stop that is configured to abut a second surface on the tab positioned opposite the first surface.

11. The lid assembly of claim 9, wherein the stop includes a ramp surface and a radial surface opposite the ramp surface, and wherein the tab is configured to engage the ramp surface of the stop during installation of the sip ring onto the thread base.

12. The lid assembly of claim 1, wherein the sip ring is configured to be coupled to the thread base by an irreversible bayonet-style coupling.

13. The lid assembly of claim 1, wherein the upper elevator and the lower elevator are configured to be coupled together via a keyed interface.

14. The lid assembly of claim 1, wherein the thread base further includes a detent configured to engage the sip ring to indicate a position of the sip ring relative to the thread base.

15. The lid assembly of claim 1, wherein the thread base includes a follower and the elevator assembly includes a helical track configured to be at least partially received by the follower.

16. The lid assembly of claim 1, wherein a D-shaped gasket ring is positioned between the sip ring and the thread base.

17. The lid assembly of claim 1, wherein the sip ring defines a hollow space.

18. The lid assembly of claim 1, wherein the upper elevator includes a ledge, and wherein the lower elevator includes a finger that is configured to snap-fit to the ledge.

19. The lid assembly of claim 1, wherein one of the upper elevator or lower elevator includes a stem and the other of the upper elevator or lower elevator includes a post, and wherein the stem is configured to be at least partially received within the post.

20. The lid assembly of claim 1, wherein the sip ring includes a tab having a first end surface, a second end surface, a ramp surface, and a surface extending between the ramp surface and the second end surface, wherein the sip ring is configured to be positioned in a ready position in which the ramp surface and the separate surface are each disposed between the first stop and the second stop, and wherein the sip ring is configured to be rotated such that the ramp surface on the tab engages a ramp surface on the second stop, allowing the tab to slide past the second stop to an installed position.

21. The lid assembly of claim 20, wherein the thread base additionally includes a radially inwardly-protruding detent configured to engage the tab on the sip ring to indicate a position of the sip ring relative to the thread base, wherein the detent includes a first ramp surface and a second ramp surface.

22. The lid assembly of claim 20, wherein the thread base includes a ledge engaged with the tab to inhibit removal of the sip ring from the thread base while permitting rotation of the sip ring relative to the thread base.

23. A lid assembly configured to be coupled to a beverage container, the lid assembly comprising:

a thread base defining an axis;

a sip ring rotatable about the axis with respect to the thread base; and an elevator assembly configured to be coupled to the sip ring, wherein the elevator assembly includes an upper elevator and a lower elevator, wherein the lower elevator is configured to be coupled to the upper elevator for co-rotation with the upper elevator;

wherein rotation of the sip ring is configured to cause the elevator assembly to translate along the axis;

wherein the elevator assembly is configured to be coupled to the sip ring for co-rotation with the sip ring about the axis;

wherein the elevator assembly includes a slot, and wherein the sip ring includes a tab that is configured to be received within the slot;

wherein the tab includes a rail that is configured to extend partially around the axis.

* * * * *